US008393455B2

(12) United States Patent
Blake et al.

(10) Patent No.: US 8,393,455 B2
(45) Date of Patent: Mar. 12, 2013

(54) COIN PROCESSING DEVICE HAVING A MOVEABLE COIN RECEPTACLE STATION

(75) Inventors: John R. Blake, St. Charles, IL (US); Gary W. Cooper, Plainfield, IL (US); Patrick J. Finn, Gilberts, IL (US); Mark C. Munro, Barrington, IL (US); Mark A. Fladeland, Bolingbrook, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 1960 days.

(21) Appl. No.: 10/797,839

(22) Filed: Mar. 10, 2004

(65) Prior Publication Data

US 2004/0256197 A1 Dec. 23, 2004

Related U.S. Application Data

(60) Provisional application No. 60/454,130, filed on Mar. 12, 2003.

(51) Int. Cl.
*G07F 9/10* (2006.01)

(52) U.S. Cl. ..... 194/350; 109/53; 206/0.84; 453/63

(58) Field of Classification Search ..... 232/15, 232/16, 1 D; 273/138.2, 138.3, 138.4, 120 R, 273/120 A; 109/22–24, 46–49, 53–57; 206/0.8–0.84; 453/63; 194/350, 353
See application file for complete search history.

(56) References Cited

U.S. PATENT DOCUMENTS

| | | | | |
|---|---|---|---|---|
| 2,570,920 A | | 10/1951 | Clough et al. | 232/16 |
| 2,669,998 A | | 2/1954 | Buchholz | 133/8 |
| 2,750,949 A | | 6/1956 | Kulo et al. | 133/8 |
| 2,835,260 A | | 5/1958 | Buchholz | 133/8 |
| 2,865,561 A | | 12/1958 | Rosapepe | 232/7 |
| 3,132,654 A | | 5/1964 | Adams | 133/1 |
| 3,376,970 A | | 4/1968 | Roseberg | 198/40 |
| 3,771,583 A | | 11/1973 | Bottemiller | 160/327 |
| 3,778,595 A | | 12/1973 | Hatanaka et al. | 235/61.7 B |
| 3,837,139 A | * | 9/1974 | Roseberg | 53/501 |
| 3,916,922 A | | 11/1975 | Prumm | 133/3 R |

(Continued)

FOREIGN PATENT DOCUMENTS

| | | |
|---|---|---|
| CA | 2235925 C | 11/1995 |
| CA | 2189330 C | 12/2000 |

(Continued)

OTHER PUBLICATIONS

Amid Industries: AI-1500 'Pulsar' High Performance Sorting and Bagging Machine, 13 pages (date unknown, but prior to Dec. 14, 2000).

(Continued)

*Primary Examiner* — Gerald McClain
(74) *Attorney, Agent, or Firm* — Nixon Peabody LLP

(57) ABSTRACT

A coin processing machine comprises a housing for containing the coin processing device, a coin processing unit disposed within the housing for processing received coins of a plurality of denominations and discharging processed coins into a plurality of coin receptacles, and a coin receptacle station disposed within the housing for holding a plurality of coin receptacles. The coin receptacle station includes a plurality of individually moveable platforms each having at least one coin receptacle disposed thereon. Each moveable platform is moveable between a first position and a second position. Each moveable platform is disposed entirely within the housing for receiving coins in the at least one coin receptacle disposed thereon when in the first position, and each moveable platform extends out of the housing when in the second position.

22 Claims, 12 Drawing Sheets

U.S. PATENT DOCUMENTS

| | | | | | |
|---|---|---|---|---|---|
| 3,998,237 | A | | 12/1976 | Kressin | 133/3 A |
| 3,998,376 | A | | 12/1976 | Myers et al. | 229/33 |
| 4,050,218 | A | | 9/1977 | Call | 53/167 |
| 4,059,122 | A | | 11/1977 | Kinoshita | 133/3 D |
| 4,075,460 | A | | 2/1978 | Gorgens | 235/420 |
| 4,124,111 | A | | 11/1978 | Hayashi | 194/102 |
| 4,150,740 | A | | 4/1979 | Douno | 194/4 C |
| 4,166,945 | A | | 9/1979 | Inoyama et al. | 235/379 |
| 4,172,462 | A | | 10/1979 | Uchida et al. | 133/3 A |
| 4,179,685 | A | | 12/1979 | O'Maley | 340/146.3 H |
| 4,179,723 | A | | 12/1979 | Spencer | 361/384 |
| 4,184,366 | A | | 1/1980 | Butler | 73/163 |
| 4,197,986 | A | | 4/1980 | Nagata | 235/379 |
| 4,208,549 | A | | 6/1980 | Polillo et al. | 179/6.3 R |
| 4,228,812 | A | | 10/1980 | Marti | 133/3 F |
| 4,232,295 | A | | 11/1980 | McConnell | 340/152 R |
| 4,234,003 | A | | 11/1980 | Ristvedt et al. | 133/3 |
| 4,249,552 | A | | 2/1981 | Margolin et al. | 133/1 R |
| 4,251,867 | A | | 2/1981 | Uchida et al. | 364/408 |
| 4,286,703 | A | | 9/1981 | Schuller et al. | 194/100 A |
| RE30,773 | E | | 10/1981 | Glaser et al. | 235/379 |
| 4,310,885 | A | | 1/1982 | Azcua et al. | 364/405 |
| 4,317,957 | A | | 3/1982 | Sendrow | 178/22.08 |
| 4,341,951 | A | | 7/1982 | Benton | 235/379 |
| 4,355,369 | A | | 10/1982 | Garvin | 364/900 |
| 4,360,034 | A | | 11/1982 | Davila et al. | 133/3 D |
| 4,369,442 | A | | 1/1983 | Werth et al. | 340/825.35 |
| 4,380,316 | A | | 4/1983 | Glinka et al. | 232/16 |
| 4,383,540 | A | * | 5/1983 | De Meyer et al. | 453/3 |
| 4,385,285 | A | | 5/1983 | Horst et al. | 382/3 |
| 4,387,942 | A | * | 6/1983 | Lense | 384/19 |
| 4,412,292 | A | | 10/1983 | Sedam et al. | 364/479 |
| 4,416,299 | A | | 11/1983 | Bergman | 133/1 R |
| 4,417,136 | A | | 11/1983 | Rushby et al. | 235/379 |
| 4,423,316 | A | | 12/1983 | Sano et al. | 235/379 |
| 4,434,359 | A | | 2/1984 | Watanabe | 235/379 |
| 4,436,103 | A | | 3/1984 | Dick | 133/3 D |
| 4,450,968 | A | * | 5/1984 | Muellner | 211/17 |
| 4,454,414 | A | | 6/1984 | Benton | 235/379 |
| 4,474,197 | A | | 10/1984 | Kinoshita et al. | 133/4 A |
| 4,488,116 | A | | 12/1984 | Plesko | 324/236 |
| 4,531,531 | A | | 7/1985 | Johnson et al. | 133/3 |
| 4,543,969 | A | | 10/1985 | Rasmussen | 133/3 |
| 4,549,561 | A | | 10/1985 | Johnson et al. | 133/3 |
| 4,556,140 | A | | 12/1985 | Okada | 194/4 C |
| 4,558,711 | A | | 12/1985 | Yoshiaki et al. | 133/3 F |
| 4,564,036 | A | | 1/1986 | Ristvedt | 133/3 |
| 4,570,655 | A | | 2/1986 | Raterman | 133/3 |
| 4,594,664 | A | | 6/1986 | Hashimoto | 364/405 |
| 4,602,332 | A | | 7/1986 | Hirose et al. | 364/408 |
| 4,607,649 | A | | 8/1986 | Taipale et al. | 133/3 C |
| 4,620,559 | A | | 11/1986 | Childers et al. | 133/3 R |
| 4,641,239 | A | | 2/1987 | Takesako | 364/408 |
| 4,674,260 | A | | 6/1987 | Rasmussen et al. | 53/212 |
| 4,681,128 | A | | 7/1987 | Ristvedt et al. | 453/6 |
| 4,705,154 | A | | 11/1987 | Masho et al. | 194/319 |
| 4,718,218 | A | | 1/1988 | Ristvedt | 53/532 |
| 4,731,043 | A | | 3/1988 | Ristvedt et al. | 453/6 |
| 4,733,765 | A | | 3/1988 | Watanabe | 194/206 |
| 4,749,074 | A | | 6/1988 | Ueki et al. | 194/317 |
| 4,753,624 | A | | 6/1988 | Adams et al. | 453/10 |
| 4,753,625 | A | | 6/1988 | Okada | 453/32 |
| 4,765,464 | A | | 8/1988 | Ristvedt | 206/0.82 |
| 4,766,548 | A | | 8/1988 | Cedrone et al. | 364/479 |
| 4,775,353 | A | | 10/1988 | Childers et al. | 453/6 |
| 4,775,354 | A | | 10/1988 | Rasmussen et al. | 453/10 |
| 4,778,983 | A | | 10/1988 | Ushikubo | 235/381 |
| 4,803,347 | A | | 2/1989 | Sugahara et al. | 235/379 |
| 4,804,830 | A | | 2/1989 | Miyagisima et al. | 235/379 |
| 4,812,629 | A | | 3/1989 | O'Neil et al. | 235/383 |
| 4,839,505 | A | | 6/1989 | Bradt et al. | 235/381 |
| 4,844,369 | A | | 7/1989 | Kanayachi | 242/56 R |
| 4,848,556 | A | | 7/1989 | Shah et al. | 194/212 |
| 4,863,414 | A | | 9/1989 | Ristvedt et al. | 453/6 |
| 4,883,158 | A | | 11/1989 | Kobayashi et al. | 194/217 |
| 4,884,212 | A | | 11/1989 | Stutsman | 364/479 |
| 4,900,909 | A | | 2/1990 | Nagashima et al. | 235/487 |
| 4,908,516 | A | | 3/1990 | West | 250/556 |
| 4,921,463 | A | | 5/1990 | Primdahl et al. | 453/3 |
| 4,936,435 | A | | 6/1990 | Griner | 194/317 |
| 4,953,086 | A | | 8/1990 | Fukatsu | 364/408 |
| 4,954,697 | A | | 9/1990 | Kokubun et al. | 235/381 |
| 4,964,495 | A | * | 10/1990 | Rasmussen | 194/344 |
| 4,966,570 | A | | 10/1990 | Ristvedt et al. | 453/6 |
| 4,970,655 | A | | 11/1990 | Winn et al. | 364/479 |
| 4,971,187 | A | | 11/1990 | Furuya et al. | 194/318 |
| 4,988,849 | A | | 1/1991 | Sasaki et al. | 235/379 |
| 4,992,647 | A | | 2/1991 | Konishi et al. | 235/379 |
| 4,995,848 | A | | 2/1991 | Goh | 453/3 |
| 5,009,627 | A | | 4/1991 | Rasmussen | 453/10 |
| 5,010,238 | A | | 4/1991 | Kadono et al. | 235/379 |
| 5,010,485 | A | | 4/1991 | Bigari | 364/408 |
| 5,011,455 | A | | 4/1991 | Rasmussen | 453/10 |
| 5,022,889 | A | | 6/1991 | Ristvedt et al. | 453/6 |
| 5,025,139 | A | | 6/1991 | Halliburton, Jr. | 235/379 |
| 5,026,320 | A | | 6/1991 | Rasmussen | 453/6 |
| 5,031,098 | A | | 7/1991 | Miller et al. | 364/405 |
| 5,033,602 | A | | 7/1991 | Saarinen et al. | 194/334 |
| 5,039,848 | A | | 8/1991 | Stoken | 235/381 |
| 5,055,086 | A | | 10/1991 | Raterman et al. | 453/10 |
| 5,055,657 | A | | 10/1991 | Miller et al. | 235/381 |
| 5,064,999 | A | | 11/1991 | Okamoto et al. | 235/379 |
| 5,080,633 | A | | 1/1992 | Ristvedt et al. | 435/6 |
| 5,091,713 | A | | 2/1992 | Horne et al. | 340/541 |
| 5,104,353 | A | | 4/1992 | Ristvedt et al. | 453/6 |
| 5,105,601 | A | | 4/1992 | Horiguchi et al. | 53/465 |
| 5,106,338 | A | | 4/1992 | Rasmussen et al. | 453/10 |
| 5,111,927 | A | | 5/1992 | Schulze | 194/209 |
| 5,114,381 | A | | 5/1992 | Ueda et al. | 453/57 |
| 5,120,945 | A | | 6/1992 | Nishibe et al. | 235/379 |
| 5,123,873 | A | | 6/1992 | Rasmussen | 453/10 |
| 5,129,205 | A | | 7/1992 | Rasmussen | 53/52 |
| 5,135,435 | A | | 8/1992 | Rasmussen | 453/56 |
| 5,140,517 | A | | 8/1992 | Nagata et al. | 364/408 |
| 5,141,443 | A | | 8/1992 | Rasmussen et al. | 453/10 |
| 5,141,472 | A | | 8/1992 | Todd et al. | 453/10 |
| 5,145,455 | A | | 9/1992 | Todd | 453/6 |
| 5,146,067 | A | | 9/1992 | Sloan et al. | 235/381 |
| 5,154,272 | A | | 10/1992 | Nishiumi et al. | 194/318 |
| 5,163,866 | A | | 11/1992 | Rasmussen | 453/10 |
| 5,163,867 | A | | 11/1992 | Rasmussen | 453/10 |
| 5,163,868 | A | | 11/1992 | Adams et al. | 453/11 |
| 5,167,313 | A | | 12/1992 | Dobbins et al. | 194/317 |
| 5,175,416 | A | | 12/1992 | Mansvelt et al. | 235/379 |
| 5,176,565 | A | | 1/1993 | Ristvedt et al. | 453/6 |
| 5,179,517 | A | | 1/1993 | Sarbin et al. | 364/410 |
| 5,183,142 | A | | 2/1993 | Latchinian et al. | 194/206 |
| 5,184,709 | A | | 2/1993 | Nishiumi et al. | 194/318 |
| 5,194,037 | A | | 3/1993 | Jones et al. | 453/10 |
| 5,197,919 | A | | 3/1993 | Geib et al. | 453/10 |
| 5,205,780 | A | | 4/1993 | Rasmussen | 453/10 |
| 5,207,784 | A | | 5/1993 | Schwartzendruber | 221/6 |
| 5,209,696 | A | | 5/1993 | Rasmussen et al. | 453/10 |
| 5,236,071 | A | | 8/1993 | Lee | 194/200 |
| 5,243,174 | A | | 9/1993 | Veeneman et al. | 235/381 |
| 5,251,738 | A | | 10/1993 | Dabrowski | 194/206 |
| 5,252,811 | A | | 10/1993 | Henochowicz et al. | 235/379 |
| 5,253,167 | A | | 10/1993 | Yoshida et al. | 364/408 |
| 5,263,566 | A | | 11/1993 | Nara et al. | 194/318 |
| 5,265,874 | A | | 11/1993 | Dickinson et al. | 273/138 A |
| 5,268,561 | A | | 12/1993 | Kimura et al. | 235/384 |
| 5,277,651 | A | | 1/1994 | Rasmussen et al. | 453/10 |
| 5,282,127 | A | | 1/1994 | Mii | 364/130 |
| 5,286,226 | A | | 2/1994 | Rasmussen | 453/10 |
| 5,286,954 | A | | 2/1994 | Sato et al. | 235/379 |
| 5,291,003 | A | | 3/1994 | Avnet et al. | 235/381 |
| 5,291,560 | A | | 3/1994 | Daugman | 382/2 |
| 5,293,981 | A | | 3/1994 | Abe et al. | 194/345 |
| 5,297,030 | A | | 3/1994 | Vassigh et al. | 364/405 |
| 5,297,598 | A | | 3/1994 | Rasmussen | 141/314 |
| 5,297,986 | A | | 3/1994 | Ristvedt et al. | 453/6 |
| 5,299,977 | A | | 4/1994 | Mazur et al. | 453/10 |
| 5,324,922 | A | | 6/1994 | Roberts | 235/375 |
| 5,326,104 | A | | 7/1994 | Pease et al. | 273/138 A |
| 5,370,575 | A | | 12/1994 | Geib et al. | 453/3 |
| 5,372,542 | A | | 12/1994 | Geib et al. | 453/10 |
| 5,374,814 | A | | 12/1994 | Kako et al. | 235/379 |

5,379,344 A 1/1995 Larsson et al. ..... 380/23
5,379,875 A 1/1995 Shames et al. ..... 194/317
5,382,191 A 1/1995 Rasmussen ..... 453/11
5,390,776 A 2/1995 Thompson ..... 194/346
5,401,211 A 3/1995 Geib et al. ..... 453/10
5,404,986 A 4/1995 Hossfield et al. ..... 194/317
5,410,590 A 4/1995 Blood et al. ..... 379/147
RE34,934 E 5/1995 Raterman et al. ..... 453/10
5,425,669 A 6/1995 Geib et al. ..... 453/10
5,429,550 A 7/1995 Mazur et al. ..... 453/10
5,440,108 A 8/1995 Tran et al. ..... 235/381
5,450,938 A 9/1995 Rademacher ..... 194/206
5,453,047 A 9/1995 Mazur et al. ..... 453/10
5,468,182 A 11/1995 Geib ..... 453/10
5,470,079 A 11/1995 LeStrange et al. ..... 273/138 A
5,474,495 A 12/1995 Geib et al. ..... 453/3
5,474,497 A 12/1995 Jones et al. ..... 453/17
5,480,348 A 1/1996 Mazur et al. ..... 453/10
5,489,237 A 2/1996 Geib et al. ..... 453/12
5,500,514 A 3/1996 Veeneman et al. ..... 235/381
5,501,631 A 3/1996 Mennie et al. ..... 453/3
5,507,379 A 4/1996 Mazur et al. ..... 194/318
5,514,034 A 5/1996 Jones et al. ..... 453/10
5,520,577 A 5/1996 Rasmussen ..... 453/56
5,538,468 A 7/1996 Ristvedt et al. ..... 453/3
5,542,880 A 8/1996 Geib et al. ..... 453/10
5,542,881 A 8/1996 Geib ..... 453/10
5,553,320 A 9/1996 Matsuura et al. ..... 235/379
5,559,887 A 9/1996 Davis et al. ..... 380/24
5,564,546 A 10/1996 Molbak et al. ..... 194/216
5,564,974 A 10/1996 Mazur et al. ..... 453/10
5,564,978 A 10/1996 Jones et al. ..... 453/17
5,570,465 A 10/1996 Tsakanikas ..... 395/114
5,573,457 A 11/1996 Watts et al. ..... 453/31
5,584,758 A 12/1996 Geib ..... 453/10
5,592,377 A 1/1997 Lipkin ..... 395/242
5,602,933 A 2/1997 Blackwell et al. ..... 382/116
5,620,079 A 4/1997 Molbak ..... 194/217
5,623,547 A 4/1997 Jones et al. ..... 380/24
5,625,562 A 4/1997 Veeneman et al. ..... 364/479.05
5,630,494 A 5/1997 Strauts ..... 194/317
5,641,050 A 6/1997 Smith et al. ..... 194/210
5,650,605 A 7/1997 Morioka et al. ..... 235/379
5,650,761 A 7/1997 Gomm et al. ..... 235/381
5,652,421 A 7/1997 Veeneman et al. ..... 235/381
5,665,952 A 9/1997 Ziarno ..... 235/380
5,679,070 A 10/1997 Ishida et al. ..... 453/41
5,684,597 A 11/1997 Hossfield et al. ..... 356/384
5,696,366 A 12/1997 Ziarno ..... 235/380
5,743,373 A 4/1998 Strauts ..... 194/318
5,746,299 A 5/1998 Molbak et al. ..... 194/200
5,774,874 A 6/1998 Veeneman et al. ..... 705/27
5,782,686 A 7/1998 Geib et al. ..... 453/10
5,799,767 A 9/1998 Molbak ..... 194/217
5,813,510 A 9/1998 Rademacher ..... 194/206
5,823,315 A 10/1998 Hoffman et al. ..... 194/203
5,830,054 A 11/1998 Petri ..... 453/5
5,838,812 A 11/1998 Pare, Jr. et al. ..... 382/115
5,842,188 A 11/1998 Ramsey et al. ..... 705/416
5,842,916 A 12/1998 Gerrity et al. ..... 453/57
5,850,076 A 12/1998 Morioka et al. ..... 235/379
5,854,581 A 12/1998 Mori et al. ..... 235/379
5,865,673 A 2/1999 Geib et al. ..... 453/10
5,880,444 A 3/1999 Shibata et al. ..... 235/379
5,892,211 A 4/1999 Davis et al. ..... 235/380
5,892,827 A 4/1999 Beach et al. ..... 380/24
5,909,793 A 6/1999 Beach et al. ..... 194/210
5,909,794 A 6/1999 Molbak et al. ..... 194/216
5,913,399 A 6/1999 Takemoto et al. ..... 194/200
5,918,748 A 7/1999 Clark et al. ..... 209/534
5,940,623 A 8/1999 Watts et al. ..... 395/712
5,944,600 A 8/1999 Zimmermann ..... 435/10
5,951,476 A 9/1999 Beach ..... 600/437
5,957,262 A 9/1999 Molbak et al. ..... 194/200
5,988,348 A 11/1999 Martin et al. ..... 194/317
5,995,949 A 11/1999 Morioka et al. ..... 705/43
5,997,395 A 12/1999 Geib et al. ..... 453/10
6,017,270 A 1/2000 Ristvedt et al. ..... 453/5
6,021,883 A 2/2000 Casanova et al. ..... 194/217
6,032,859 A 3/2000 Muehlberger et al. ..... 235/449
6,039,644 A 3/2000 Geib et al. ..... 453/10
6,039,645 A 3/2000 Mazur ..... 453/10
6,042,470 A * 3/2000 Geib et al. ..... 453/10
6,047,807 A 4/2000 Molbak ..... 194/217
6,047,808 A 4/2000 Neubarth et al. ..... 194/317
6,056,104 A 5/2000 Neubarth et al. ..... 194/317
6,080,056 A 6/2000 Karlsson ..... 453/3
6,082,519 A 7/2000 Martin et al. ..... 194/350
6,086,471 A 7/2000 Zimmermann ..... 453/3
6,095,313 A 8/2000 Molbak et al. ..... 194/344
6,116,402 A 9/2000 Beach et al. ..... 194/216
6,131,625 A 10/2000 Casanova et al. ..... 141/314
6,139,418 A 10/2000 Geib et al. ..... 453/10
6,142,285 A 11/2000 Panzeri et al. ..... 194/328
6,145,738 A 11/2000 Stinson et al. ..... 235/379
6,154,879 A 11/2000 Pare, Jr. et al. ..... 902/3
6,168,001 B1 1/2001 Davis ..... 194/200
6,171,182 B1 1/2001 Geib et al. ..... 453/10
6,174,230 B1 1/2001 Gerrity et al. ..... 453/57
6,196,371 B1 3/2001 Martin et al. ..... 194/317
6,196,913 B1 3/2001 Geib et al. ..... 453/10
6,230,928 B1 5/2001 Hanna et al. ..... 221/13
6,264,545 B1 * 7/2001 Magee et al. ..... 453/3
6,290,050 B1 * 9/2001 Mikami et al. ..... 194/350
6,293,540 B1 * 9/2001 Kovacs ..... 271/162
6,308,887 B1 10/2001 Korman et al. ..... 235/379
6,318,536 B1 11/2001 Korman et al. ..... 194/217
6,318,537 B1 * 11/2001 Jones et al. ..... 194/346
6,349,972 B1 2/2002 Geiger et al. ..... 283/67
6,412,620 B1 7/2002 Imura ..... 194/317
6,431,342 B1 8/2002 Schwartz ..... 194/346
6,438,230 B1 8/2002 Moore ..... 380/42
6,456,928 B1 9/2002 Johnson ..... 701/114
6,471,030 B1 10/2002 Neubarth et al. ..... 194/317
6,474,548 B1 11/2002 Montross et al. ..... 235/379
6,484,863 B1 11/2002 Molbak ..... 194/216
6,484,884 B1 11/2002 Gerrity et al. ..... 209/233
6,494,776 B1 12/2002 Molbak ..... 453/32
6,499,277 B1 12/2002 Warner et al. ..... 53/447
6,503,138 B2 1/2003 Spoehr et al. ..... 453/10
6,520,308 B1 2/2003 Martin et al. ..... 194/317
6,522,772 B1 2/2003 Morrison et al. ..... 382/124
6,547,131 B1 4/2003 Foodman et al. ..... 235/380
6,552,781 B1 4/2003 Rompel et al. ..... 256/71
6,554,185 B1 4/2003 Montross et al. ..... 235/379
6,579,165 B2 * 6/2003 Kuhlin et al. ..... 453/3
6,581,042 B2 6/2003 Pare, Jr. et al. ..... 705/40
6,602,125 B2 8/2003 Martin ..... 453/12
6,609,604 B1 * 8/2003 Jones et al. ..... 194/302
6,612,921 B2 9/2003 Geib et al. ..... 453/13
6,637,576 B1 * 10/2003 Jones et al. ..... 194/216
6,640,956 B1 11/2003 Zwieg et al. ..... 194/328
6,644,696 B2 11/2003 Brown et al. ..... 283/67
6,655,585 B2 12/2003 Shinn ..... 235/382
6,659,259 B2 12/2003 Knox et al. ..... 194/217
6,662,166 B2 12/2003 Pare, Jr. et al. ..... 705/39
6,663,675 B2 12/2003 Blake et al. ..... 753/63
6,666,318 B2 12/2003 Gerrity et al. ..... 194/347
6,719,121 B2 * 4/2004 Alexander et al. ..... 194/350
6,755,730 B2 6/2004 Geib et al. ..... 453/3
6,758,316 B2 7/2004 Molbak ..... 194/200
6,761,308 B1 7/2004 Hanna et al. ..... 235/379
6,766,892 B2 7/2004 Martin et al. ..... 194/317
6,783,452 B2 8/2004 Hino et al. ..... 453/3
6,783,785 B1 8/2004 Raghavan et al. ..... 426/489
6,786,398 B1 9/2004 Stinson et al. ..... 235/379
6,854,581 B2 2/2005 Molbak ..... 194/344
6,854,640 B2 2/2005 Peklo ..... 235/100
6,863,168 B1 3/2005 Gerrity et al. ..... 194/347
6,892,871 B2 5/2005 Strauts et al. ..... 194/302
6,896,118 B2 5/2005 Jones et al. ..... 194/217
6,918,826 B2 * 7/2005 Nakajima et al. ..... 453/3
6,928,546 B1 8/2005 Nanavati et al. ..... 713/186
6,950,810 B2 9/2005 Lapsley et al. ..... 705/78
6,953,150 B2 10/2005 Shepley et al. ..... 235/379
6,957,746 B2 10/2005 Martin et al. ..... 221/131
6,966,417 B2 * 11/2005 Peklo et al. ..... 194/344
6,976,570 B2 12/2005 Molbak ..... 194/215

| | | | | |
|---|---|---|---|---|
| 6,988,606 | B2 | 1/2006 | Geib et al. | 194/334 |
| 6,991,530 | B2 | 1/2006 | Hino et al. | 453/3 |
| 7,004,831 | B2 | 2/2006 | Hino et al. | 453/5 |
| 7,014,029 | B2 | 3/2006 | Winters | 194/302 |
| 7,014,108 | B2 | 3/2006 | Sorenson et al. | 235/381 |
| 7,017,729 | B2 | 3/2006 | Gerrity et al. | 194/347 |
| 7,018,286 | B2 | 3/2006 | Blake et al. | 453/61 |
| 7,028,827 | B1 | 4/2006 | Molbak et al. | 194/346 |
| 7,036,651 | B2 | 5/2006 | Tam et al. | 194/217 |
| 7,083,036 | B2 | 8/2006 | Adams | 194/223 |
| 7,103,438 | B2 * | 9/2006 | Hallowell et al. | 700/116 |
| 7,113,929 | B1 | 9/2006 | Beach et al. | 705/65 |
| 7,131,580 | B2 | 11/2006 | Molbak | 235/379 |
| 7,149,336 | B2 | 12/2006 | Jones et al. | 382/135 |
| 7,152,727 | B2 | 12/2006 | Waechter | 194/317 |
| 7,158,662 | B2 | 1/2007 | Chiles | 382/135 |
| 7,188,720 | B2 | 3/2007 | Geib et al. | 194/302 |
| 7,213,697 | B2 | 5/2007 | Martin et al. | 194/317 |
| 7,243,773 | B2 | 7/2007 | Bochonok et al. | 194/350 |
| 7,269,279 | B2 | 9/2007 | Chiles | 382/135 |
| 7,303,119 | B2 | 12/2007 | Molbak | 235/379 |
| 7,331,521 | B2 | 2/2008 | Sorenson et al. | 235/381 |
| 7,337,890 | B2 | 3/2008 | Bochonok et al. | 194/353 |
| 7,427,230 | B2 | 9/2008 | Blake et al. | 453/63 |
| 7,438,172 | B2 | 10/2008 | Long et al. | 194/347 |
| 7,464,802 | B2 | 12/2008 | Gerrity et al. | 194/347 |
| 7,520,374 | B2 | 4/2009 | Martin et al. | 194/317 |
| 7,551,764 | B2 | 6/2009 | Chiles et al. | 382/135 |
| 7,552,810 | B2 | 6/2009 | Mecklenburg | 194/317 |
| 7,580,859 | B2 | 8/2009 | Economy | 705/16 |
| 7,654,450 | B2 | 2/2010 | Mateen et al. | 235/379 |
| 7,658,270 | B2 | 2/2010 | Bochonok et al. | 194/350 |
| 7,743,902 | B2 | 6/2010 | Wendell et al. | 194/302 |
| 7,778,456 | B2 | 8/2010 | Jones et al. | 382/135 |
| 7,819,308 | B2 | 10/2010 | Osterberg et al. | 235/379 |
| 7,874,478 | B2 | 1/2011 | Molbak | 235/379 |
| 7,886,980 | B2 | 2/2011 | Blake et al. | 194/347 |
| 7,931,304 | B2 | 4/2011 | Brown et al. | 283/57 |
| 7,946,406 | B2 | 5/2011 | Blake et al. | 194/200 |
| 7,963,382 | B2 | 6/2011 | Wendell et al. | 194/302 |
| 7,980,378 | B2 | 7/2011 | Jones et al. | 194/217 |
| 8,023,715 | B2 | 9/2011 | Jones et al. | 382/135 |
| 8,042,732 | B2 | 10/2011 | Blake et al. | 235/375 |
| 8,229,821 | B2 | 7/2012 | Mennie et al. | 232/16 |
| 2001/0008358 | A1 * | 7/2001 | Brustle | 312/319.1 |
| 2001/0034203 | A1 | 10/2001 | Geib et al. | 453/3 |
| 2001/0048025 | A1 | 12/2001 | Shinn | 235/382 |
| 2002/0011393 | A1 * | 1/2002 | Siemens | 194/215 |
| 2002/0065033 | A1 | 5/2002 | Geib et al. | 453/3 |
| 2002/0069104 | A1 | 6/2002 | Beach et al. | 705/14 |
| 2002/0074209 | A1 | 6/2002 | Karlsson | 194/330 |
| 2002/0095587 | A1 | 7/2002 | Doyle et al. | 713/186 |
| 2002/0107738 | A1 | 8/2002 | Beach et al. | 705/14 |
| 2002/0126885 | A1 | 9/2002 | Mennie et al. | 382/135 |
| 2002/0130011 | A1 * | 9/2002 | Casanova et al. | 194/344 |
| 2002/0147588 | A1 | 10/2002 | Davis et al. | 704/246 |
| 2002/0151267 | A1 | 10/2002 | Kuhlin et al. | 453/3 |
| 2002/0162724 | A1 * | 11/2002 | Hino et al. | 194/215 |
| 2002/0174348 | A1 | 11/2002 | Ting | 713/186 |
| 2002/0179401 | A1 | 12/2002 | Knox et al. | 194/217 |
| 2003/0004878 | A1 | 1/2003 | Akutsu et al. | 705/43 |
| 2003/0013403 | A1 | 1/2003 | Blake et al. | 453/60 |
| 2003/0081824 | A1 | 5/2003 | Mennie et al. | 382/135 |
| 2003/0127299 | A1 | 7/2003 | Jones et al. | 194/217 |
| 2003/0168309 | A1 * | 9/2003 | Geib et al. | 194/302 |
| 2003/0168310 | A1 | 9/2003 | Strauts et al. | 194/302 |
| 2003/0182217 | A1 | 9/2003 | Chiles | 705/35 |
| 2003/0190882 | A1 | 10/2003 | Blake et al. | 453/63 |
| 2003/0220064 | A1 * | 11/2003 | Svensson | 453/59 |
| 2003/0234153 | A1 | 12/2003 | Blake et al. | 194/347 |
| 2004/0055902 | A1 * | 3/2004 | Peklo | 206/0.815 |
| 2004/0092222 | A1 | 5/2004 | Kowalczyk et al. | 453/12 |
| 2004/0153406 | A1 | 8/2004 | Alarcon-Luther et al. | 705/41 |
| 2004/0153421 | A1 | 8/2004 | Robinson | 705/75 |
| 2004/0154899 | A1 | 8/2004 | Peklo et al. | 193/33 |
| 2004/0173432 | A1 | 9/2004 | Jones | 194/216 |
| 2004/0188221 | A1 | 9/2004 | Carter | 194/215 |
| 2004/0200691 | A1 | 10/2004 | Geib et al. | 194/302 |
| 2004/0256197 | A1 | 12/2004 | Blake et al. | 194/350 |
| 2005/0006197 | A1 | 1/2005 | Wendell et al. | 194/302 |
| 2005/0035140 | A1 | 2/2005 | Carter | 221/195 |
| 2005/0040007 | A1 | 2/2005 | Geib et al. | 194/302 |
| 2005/0040225 | A1 | 2/2005 | Csulits et al. | 235/379 |
| 2005/0045450 | A1 | 3/2005 | Geib et al. | 194/318 |
| 2005/0067305 | A1 | 3/2005 | Bochonok et al. | 206/8 |
| 2005/0077142 | A1 | 4/2005 | Tam et al. | 194/217 |
| 2005/0087425 | A1 | 4/2005 | Peklo | 194/350 |
| 2005/0108165 | A1 | 5/2005 | Jones et al. | 705/43 |
| 2005/0109836 | A1 | 5/2005 | Ben-Aissa | 235/380 |
| 2005/0124407 | A1 | 6/2005 | Rowe | 463/25 |
| 2005/0156318 | A1 | 7/2005 | Douglas | 257/761 |
| 2005/0205654 | A1 | 9/2005 | Carter | 235/7 R |
| 2005/0205655 | A1 | 9/2005 | Carter | 235/7 R |
| 2005/0228717 | A1 | 10/2005 | Gusler et al. | 705/14 |
| 2005/0256792 | A1 | 11/2005 | Shimizu et al. | 705/35 |
| 2006/0037835 | A1 | 2/2006 | Doran et al. | 194/302 |
| 2006/0054455 | A1 | 3/2006 | Kuykendall et al. | 194/217 |
| 2006/0054457 | A1 | 3/2006 | Long et al. | 194/347 |
| 2006/0060363 | A2 | 3/2006 | Carter | 172/111 |
| 2006/0064379 | A1 | 3/2006 | Doran et al. | 705/42 |
| 2006/0069654 | A1 | 3/2006 | Beach et al. | 705/65 |
| 2006/0148394 | A1 | 7/2006 | Blake et al. | 453/12 |
| 2006/0149415 | A1 | 7/2006 | Richards | 700/236 |
| 2006/0151285 | A1 | 7/2006 | String | 194/350 |
| 2006/0154589 | A1 | 7/2006 | String | 453/11 |
| 2006/0175176 | A1 | 8/2006 | Blake | 194/216 |
| 2006/0182330 | A1 | 8/2006 | Chiles | 382/135 |
| 2006/0196754 | A1 | 9/2006 | Bochonok et al. | 194/347 |
| 2006/0205481 | A1 | 9/2006 | Dominelli | 463/25 |
| 2006/0207856 | A1 | 9/2006 | Dean et al. | 194/302 |
| 2006/0219519 | A1 | 10/2006 | Molbak et al. | 194/346 |
| 2006/0283685 | A1 | 12/2006 | Cousin | 194/217 |
| 2007/0051582 | A1 | 3/2007 | Bochonok et al. | 194/202 |
| 2007/0071302 | A1 | 3/2007 | Jones et al. | 382/135 |
| 2007/0108015 | A1 | 5/2007 | Bochonok et al. | 194/350 |
| 2007/0119681 | A1 | 5/2007 | Blake et al. | 194/215 |
| 2007/0181676 | A1 | 8/2007 | Mateen et al. | 235/381 |
| 2007/0187494 | A1 | 8/2007 | Hanna | 235/383 |
| 2007/0221470 | A1 | 9/2007 | Mennie et al. | 194/216 |
| 2007/0269097 | A1 | 11/2007 | Chiles et al. | 382/135 |
| 2008/0033829 | A1 | 2/2008 | Mennie et al. | 705/16 |
| 2008/0044077 | A1 | 2/2008 | Mennie et al. | 382/135 |
| 2008/0220707 | A1 | 9/2008 | Jones et al. | 453/2 |
| 2009/0018959 | A1 | 1/2009 | Doran et al. | 705/44 |
| 2009/0236200 | A1 | 9/2009 | Hallowell et al. | 194/215 |
| 2009/0236201 | A1 | 9/2009 | Blake et al. | 194/215 |
| 2009/0239459 | A1 | 9/2009 | Watts et al. | 453/18 |
| 2009/0242626 | A1 | 10/2009 | Jones et al. | 235/379 |
| 2009/0320106 | A1 | 12/2009 | Jones et al. | 726/5 |
| 2010/0038419 | A1 | 2/2010 | Blake et al. | 235/379 |
| 2010/0198726 | A1 | 8/2010 | Doran et al. | 705/41 |
| 2010/0261421 | A1 | 10/2010 | Wendell et al. | 453/4 |
| 2010/0276485 | A1 | 11/2010 | Jones et al. | 235/379 |
| 2010/0327005 | A1 | 12/2010 | Martin et al. | 221/98 |
| 2011/0098845 | A1 | 4/2011 | Mennie et al. | 700/223 |
| 2011/0099105 | A1 | 4/2011 | Mennie et al. | 705/41 |
| 2011/0270695 | A1 | 11/2011 | Jones et al. | 705/43 |
| 2012/0067950 | A1 | 3/2012 | Blake | 235/381 |
| 2012/0156976 | A1 | 6/2012 | Blake et al. | 453/4 |

FOREIGN PATENT DOCUMENTS

| | | | |
|---|---|---|---|
| CA | 2143943 | C | 3/2003 |
| DE | 06 60 354 | | 5/1938 |
| DE | 30 21 327 | A1 | 12/1981 |
| EP | 0 351 217 | A2 | 1/1990 |
| EP | 0 667 973 | B1 | 1/1997 |
| EP | 0 926 634 | A2 | 6/1999 |
| EP | 1 104 920 | A1 | 6/2001 |
| EP | 1 209 639 | A2 | 5/2002 |
| EP | 1 528 513 | A1 | 5/2005 |
| FR | 2042254 | | 2/1971 |
| GB | 2035642 | A | 6/1980 |
| GB | 2175427 | A | 11/1986 |
| GB | 2198274 | A | 6/1988 |
| GB | 2458387 | A | 9/2009 |
| GB | 2468783 | A | 9/2010 |
| JP | 49-058899 | | 6/1974 |
| JP | 52-014495 | | 2/1977 |

| | | | |
|---|---|---|---|
| JP | 52-071300 | A | 6/1977 |
| JP | 56-040992 | A | 4/1981 |
| JP | 57-117080 | A | 7/1982 |
| JP | 59-079392 | A | 5/1984 |
| JP | 60-016271 | U | 2/1985 |
| JP | 62-134168 | U | 8/1987 |
| JP | 62-182995 | A | 8/1987 |
| JP | 62-221773 | A | 9/1987 |
| JP | 62-166562 | U | 10/1987 |
| JP | 64-035683 | A | 2/1989 |
| JP | 64-042789 | A | 2/1989 |
| JP | 64-067698 | A | 3/1989 |
| JP | 01-118995 | A | 5/1989 |
| JP | 01-307891 | A | 12/1989 |
| JP | 02-050793 | A | 2/1990 |
| JP | 02-252096 | A | 10/1990 |
| JP | 03-012776 | A | 1/1991 |
| JP | 03-063795 | A | 3/1991 |
| JP | 03-092994 | A | 4/1991 |
| JP | 03-156673 | A | 7/1991 |
| JP | 04-085695 | A | 3/1992 |
| JP | 04-175993 | A | 6/1992 |
| JP | 05-046839 | A | 2/1993 |
| JP | 05-217048 | A | 8/1993 |
| JP | 05-274527 | A | 10/1993 |
| JP | 06-035946 | A | 2/1994 |
| JP | 06-103285 | A | 4/1994 |
| JP | 09-251566 | A | 9/1997 |
| JP | 2002-117439 | A | 4/2002 |
| JP | 2003-242287 | A | 8/2003 |
| JP | 2004-213188 | A | 7/2004 |
| SE | 44 244 | | 9/1988 |
| WO | WO 85/00909 | A1 | 2/1985 |
| WO | WO 91/06927 | A1 | 5/1991 |
| WO | WO 91/08952 | A1 | 6/1991 |
| WO | WO 91/12594 | A1 | 8/1991 |
| WO | WO 91/18371 | A1 | 11/1991 |
| WO | WO 92/08212 | A1 | 5/1992 |
| WO | WO 92/20043 | A1 | 11/1992 |
| WO | WO 92/20044 | A1 | 11/1992 |
| WO | WO 92/22044 | A1 | 12/1992 |
| WO | WO 93/00660 | A1 | 1/1993 |
| WO | WO 93/09621 | A1 | 5/1993 |
| WO | WO 94/06101 | A1 | 3/1994 |
| WO | WO 94/08319 | A1 | 4/1994 |
| WO | WO 94/23397 | A1 | 10/1994 |
| WO | WO 95/02226 | A1 | 1/1995 |
| WO | WO 95/04978 | A1 | 2/1995 |
| WO | WO 95/06920 | A1 | 3/1995 |
| WO | WO 95/09406 | A1 | 4/1995 |
| WO | WO 95/13596 | A1 | 5/1995 |
| WO | WO 95/19017 | A1 | 7/1995 |
| WO | WO 95/23387 | A1 | 8/1995 |
| WO | WO 95/30215 | A1 | 11/1995 |
| WO | WO 96/07163 | A1 | 3/1996 |
| WO | WO 96/07990 | A1 | 3/1996 |
| WO | WO 96/12253 | A1 | 4/1996 |
| WO | WO 96/27525 | A1 | 9/1996 |
| WO | WO 96/27859 | A1 | 9/1996 |
| WO | WO 97/22919 | A1 | 6/1997 |
| WO | WO 97/25692 | A1 | 7/1997 |
| WO | WO 98/24041 | A1 | 6/1998 |
| WO | WO 98/24067 | A1 | 6/1998 |
| WO | WO 98/48383 | A2 | 10/1998 |
| WO | WO 98/48384 | A2 | 10/1998 |
| WO | WO 98/48385 | A2 | 10/1998 |
| WO | WO 98/51082 | A1 | 11/1998 |
| WO | WO 98/59323 | A1 | 12/1998 |
| WO | WO 99/00776 | A1 | 1/1999 |
| WO | WO 99/06937 | A1 | 2/1999 |
| WO | WO 99/16027 | A2 | 4/1999 |
| WO | WO 99/33030 | A1 | 7/1999 |
| WO | WO 99/41695 | A1 | 8/1999 |
| WO | WO 99/48057 | A1 | 9/1999 |
| WO | WO 99/48058 | A1 | 9/1999 |
| WO | WO 00/48911 | A1 | 8/2000 |
| WO | WO 00/65546 | A1 | 11/2000 |
| WO | WO 01/63565 | A2 | 8/2001 |
| WO | WO 02/071343 | A1 | 9/2002 |
| WO | WO 03/052700 | A2 | 6/2003 |
| WO | WO 03/079300 | A1 | 9/2003 |
| WO | WO 03/085610 | A1 | 10/2003 |
| WO | WO 03/107280 | A2 | 12/2003 |
| WO | WO 2004/044853 | A1 | 5/2004 |
| WO | WO 2004/109464 | A2 | 12/2004 |
| WO | WO 2005/041134 | A2 | 5/2005 |
| WO | WO 2005/088563 | A1 | 9/2005 |
| WO | WO 2006/086531 | A1 | 8/2006 |
| WO | WO 2007/035420 | A2 | 3/2007 |
| WO | WO 2007/120825 | A2 | 10/2007 |

OTHER PUBLICATIONS

Aui: Coinverter - "No. More Lines . . .Self-Serve Cash-Out," by Cassius Elston, 1995 World Games Congress/Exposition Converter, 1 page (dated prior to 1995).
Brandt: 95 Series Coin Sorter Counter, 2 pages (1982).
Brandt: Model 817 Automated Coin and Currency Ordering System, 2 pages (1983).
Brandt: Model 920/925 Counter, 2 pages (date unknown, prior to Jul. 2011, possibly prior to Mar. 17, 1997).
Brandt: System 930 Electric Counter/Sorter, "Solving Problems, Pleasing Customer, Building Deposits," 1 page (date unknown, prior to Mar. 2, 2011, possibly prior to Mar. 17, 1997).
Brandt: Model 940-6 High Speed Sorter/Counter, 2 pages (date unknown, prior to Oct. 31, 1989).
Brandt: System 945 High-Speed Sorter, 2 pages (date unknown, prior to Mar. 2, 2011, possibly prior to Mar. 17, 1997).
Brandt: Model 952 Coin Sorter/Counter, 2 pages (date unknown, prior to Oct. 31, 1989).
Brandt: Model 954 Coin Sorter/Counter, 2 pages (date unknown, prior to Oct. 31, 1989).
Brandt: Model 957 Coin Sorter/Counter, 2 pages (date unknown, prior to Oct. 31, 1989).
Brandt: Model 958 Coin Sorter/Counter, 5 pages (©1982).
Brandt: Model 960 High-Speed Coin Sorter & Counter, 2 pages (1984).
Brandt; Model 966 Microsort™ Coin Sorter and Counter, 4 pages, (1979).
Brandt: Model 970 Coin Sorter and Counter, 2 pages (1983).
Brandt: Model 1205 Coin Sorter Counter, 2 pages (1986).
Brandt: Model 1400 Coin Sorter Counter, 2 pages (date unknown, prior to Mar. 2, 2011, possibly prior to Mar. 17, 1997).
Brandt: Model 8904 Upfeed —"High Speed 4-Denomination Currency Dispenser," 2 pages (1989).
Brandt: Mach 7 High-Speed Coin Sorter/Counter, 2 pages (1992).
Case ICC Limited: CDS Automated Receipt Giving Cash Deposit System, 3 pages (date unknown, prior to Nov. 15, 2000).
Childers Corporation: Computerized Sorter/Counter, "To coin an old adage, time is money..,"3 pages (1981).
Cummins: Cash Information and Settlement Systems (Form 023-1408), 4 pages (date Dec. 1991).
Cummins: The Universal Solution to All Coin and Currency Processing Needs (Form 13C1218 3-83), 1 page (Mar. 1983).
Cummins: JetSort® High Speed Sorter/Counter Kits I & J—Operating Instructions (Form 022-7123-00) 12 pages (1994).
Cummins: JetSort® Coin Sorter Counter/CA-130XL Coin Wrapper, Cummins Automated Money Systems (AMS) Case Study —Fifth-Third, "6,000 Coin Per Minute Counter/Sorter Keeps pace With Fifth-Third Bank's Money Processing Needs," (Form 13C1180), 2 pages (Nov. 1981).
Cummins: JetSort®, "Venders Love JetSort," (13C1255), 1 page (Mar. 1987).
Cummins: JetSort® "High Speed Coin Sorter & Counter for Payphone Applications," "CTOCS Ready" (Form 023-1365), 2 pages (Mar. 1989).
Cummins: JetSort® mailer, "One moving part simplicity," "Vendors —Are validators changing your coin and currency needs?" (Form 023-1297), 3 pages (Apr. 1987).
Cummins: JetSort® Series V High Speed Coin Sorter/Counter, (Form 023-1383), 2 pages (Sep. 1990).
Cummins: JetSort® "Time for a Change, Be a smashing success!," (Form 023-1328), 1 page (Jun. 1988).

Cummins: JetSort® "Time for a Change —JetSort® vs. Brandt X," (Form 023-1330), 1 page (Jun. 1988).
Cummins: JetSort® "Time for a Change —No. Coins Sorted After 3:00 or on Saturday," (Form 023-1327), 1 page (Aug. 1988).
Cummins: JetSort®, "What do all these Banks have in Common . . .?", JetSort, CA-130XL coin wrapper, CA-118 coin wrapper, Ca-4000 JetCount, (13C1203), 3 pages (Aug. 1982).
Cummins: JetSort® 700-01/CA-118 Coin Wrapper, Cummins Automated Money Systems (AMS) Case Study —University State Bank, "Cummins Money Processing System Boosts Teller Service at University State Bank,"(Form 13C1192), 2 pages (Mar. 1982).
Cummins: JetSort® 700-01, Cummins Automated Money Systems (AMS) Case Study —First State Bank of Oregon, "JetSort® Gives Bank Coin Service Edge," (Form 13C1196), 2 pages (Apr. 1982).
Cummins: JetSort® 700-01 Coin Sorter/Counter, Operating Instructions, 14 pages (1982).
Cummins: JetSort® 701, Cummins Automated Money Systems (AMS) Case Study —Convenco Vending, "High Speed Coin Sorter increases coin processing power at Convenco Vending," (Form 13C1226), 2 pages (Jul. 1983).
Cummins: JetSort Models 701 and 750 , "State-of-the-art coin processing comes of age," 2 pages (Feb. 1984).
Cummins: JetSort® Model CA-750 Coin Processor (Item No. 50-152), 1 page (Jul. 1984).
Cummins: JetSort® Model CA-750 Coin Sorter/Counter and CA-4050 JetCount currency counter, "Money Processing Made Easy," (Form 13C1221) 2 pages (Jun. 1983).
Cummins: JetSort® Model 1701 with JetStops, Operating Instructions Manual (Form 022-1329-00), 16 pages (1984).
Cummins: JetSort® Model 1760 brochure, (Form 023-1262-00), 2 pages (Jul. 1985).
Cummins: JetSort® Models 1770 and 3000, Communication Package specification and operating instructions, 10 pages (uncertain, possibly Nov. 1985).
Cummins: JetSort® Model 1770, "JetSort® Speed and Accuracy, Now with Communications !", (Form 023-1272) 1 page (Oct. 1986).
Cummins: JetSort® 2000 Series High Speed Coin Sorter/Counter (Form 023-1488), 2 pages (Oct. 2000).
Cummins: JetSort®3000 Series High Speed Coin Sorter (Form 023-1468 Rev 1), 2 pages (Feb. 1995).
Cummins: JetSort®3000 Series Options, "Talking JetSort 3000," (Form 023-1338-00), 1 page (between Jan. 1989-Feb. 1989).
Cummins: JetSort®3000, "3,000 Coins per Minute!," (Form 023-1312), 1 page (date unknown, est. 1987).
Cummins: JetSort®3200, Enhanced electronics for the JetSort® 3200 (Form 023-1350), 1 page (Apr. 1987).
De La Rue: CDS 500 Cash Deponier System, 6 pages (date unknown, p. 5 has date May 1994, p. 6 has date Dec. 1992) (German).
De La Rue: CDS 5700 and CDS 5800 Cash Deponier System (German) and translation, 7 pages (date unknown, prior to Aug. 13, 1996).
Diebold: Merchant MicroBranch, "Merchant MicroBranch Combines ATM After-Hour Depository Rolled-Coin Dispenser," Bank Technology News, 1 page (Nov. 1997).
Fa. GBS-Geldbearbeitungssysteme: GBS9401SB Technical Specification, 24 pages (date unknown, prior to Nov. 11, 2010).
Frisco Bay: Commercial Kiosk, "Provide self-service solutions for your business customers," 4 pages (date unknown, prior to Mar. 2, 2011, p. 4 has date 1996).
Glory: AMT Automated Merchant Teller, 4 pages (date unknown, prior to Jan. 15, 2001).
Glory: CRS-8000 Cash Redemption System, 2 pages (1996).
Hamilton: Hamilton's Express Banking Center, in Less Space Than a Branch Manager's Desk, 4 pages (date unknown, prior to Jan. 15, 2001).
ISH Electronic: ISH I2005/500 Coin Counter (with translation), 4 pages (date unknown, prior to Aug. 1996).
ISH Electronic: ISH I2005/501 Self-Service Unit (with translation), 4 pages (date unknown, prior to Aug. 1996).
Namsys, Inc.: Namsys Express, Making currency management . . .more profitable, 2 pages (date unknown, prior to Jan. 15, 2001).
NGZ Geldzahlmaschinengesellschaft: NGZ 2100 Automated Coin Depository, 4 pages (date unknown, prior to Sep. 1996).
Perconta: Contomat Coin Settlement Machine for Customer Self Service, 2 pages (date unknown, prior to Apr. 2003).
Prema GmbH: Prema 405 (RE) Self Service Coin Deposit Facility, 2 pages (date unknown, prior to Apr. 2003).
Reis Eurosystems: CRS 6501/CRS 6510 Cash Receipt Systems for Self-Service Area, 3 pages (date unknown, prior to Apr. 2003).
Reis Eurosystems: CRS 6520/ CRS 6525 Standard-Class Coin Deposit Systems, 1 page (date unknown, prior to Apr. 2003).
Reis Eurosystems: CS 3510 Disc-Sorter, 1 page (date unknown, prior to Apr. 2003).
Royal Bank: Hemeon, Jade, "Royal's Burlington drive-in bank provides customers 24-hour tellers," The Toronto Star, 1 page (Aug. 21, 1991).
Royal Bank: Leitch, Carolyn, "High-Tech Bank Counts Coins," The Globe and Mail, 2 pages (Sep. 19, 1991).
Royal Bank: Oxby, Murray, "Royal Bank Opens 'Super Branch,'" The Gazette Montreal, 2 pages (Sep. 14, 1991).
Scan Coin: International Report, 49 pages (Apr. 1987).
Scan Coin: World, 2 pages (Feb. 1988).
Scan Coin: CDS Coin Deposit System—Technical Referens Manual, 47 pages (1989).
Scan Coin: CDS 600 User's Manual, 14 pages (date unknown, prior to Apr. 2003).
Scan Coin: CDS 600 & CDS 640 Cash Deposit System—Technical Manual, 45 pages (date unknown, prior to Apr. 2003).
Scan Coin: CDS MK 1 Coin Deposit System—Technical Manual, 32 pages (1991).
Scan Coin: SC 102 Value Counter Technical Manual, 28 pages (date unknown, prior to Apr. 2003).
Pay by Touch: Secure ID News, "Piggly Wiggly Extends Biometric Payments Throughout the Southeast U.S.," 2 pages, (Dec. 14, 2005).
ESD, Inc: Smartrac Card System, "Coinless laundry makes quarters obsolete; Smartrac Card System really makes a change in laundry industry," Business Wire, 2 pages (Feb. 23, 1996).
Meece, Mickey: Article "Development Bank of Singapore Gets Cobranding Edge with Smart Cards," American Banker, New York, Ny, vol. 159, Iss. 195, pp. 37, 2 pages (Oct. 10, 1994).

* cited by examiner

COIN PROCESSING DEVICE HAVING A MOVEABLE COIN RECEPTACLE STATION

CROSS-REFERENCE TO RELATED APPLICATION

This application claims the benefit of U.S. Provisional Patent Application No. 60/454,130, entitled "Coin Processing System Having Moveable Coin Receptacle Station," which was filed on Mar. 12, 2003 and is incorporated herein by reference in its entirety.

FIELD OF THE INVENTION

The present invention relates generally to coin processing devices and, more particularly, to a coin redemption machine that provides improved access to the coin-containing receptacles of the coin processing device.

BACKGROUND OF THE INVENTION

Coin processing machines generally have the ability to receive bulk coins from a user of the machine. Coin processing machines include a redemption type of machine wherein, after the deposited coins are counted, a receipt is issued indicating the value of the deposited coins. The user may redeem this receipt for the amount of deposited coins in the form of banknotes. In other embodiments, the receipt is redeemed for the amount of the deposited coins less a commission charged for use of the coin redemption machine.

Coin redemption machines are commonly used in a banking environment and/or a retail environment such as a grocery store. Because the coin redemption machines are placed in an area accessible by the general public, it is necessary to take security precautions such as disposing the coin containing receptacles (e.g., coin bags) of the redemption machine within a secure housing. However, placing the coin bags within a housing makes it difficult for an operator to access all of the coin bags such as, for example, the coin bags that may be disposed behind the other coin bags. Thus, there exists a need to provide greater access to the coin receptacles contained within a coin redemption machine.

SUMMARY OF THE INVENTION

A coin processing machine comprises a housing for containing the coin processing device, a coin processing unit disposed within the housing for processing received coins of a plurality of denominations and discharging processed coins into a plurality of coin receptacles, and a coin receptacle station disposed within the housing for holding a plurality of coin receptacles. The coin receptacle station includes a plurality of individually moveable platforms each having at least one coin receptacle disposed thereon. Each moveable platform is moveable between a first position and a second position. Each moveable platform is disposed entirely within the housing for receiving coins in the at least one coin receptacle disposed thereon when in the first position, and each moveable platform extends out of the housing when in the second position.

The above summary of the present invention is not intended to represent each embodiment, or every aspect, of the present invention. Additional features and benefits of the present invention are apparent from the detailed description, figures, and embodiments set forth below.

Figure 1:
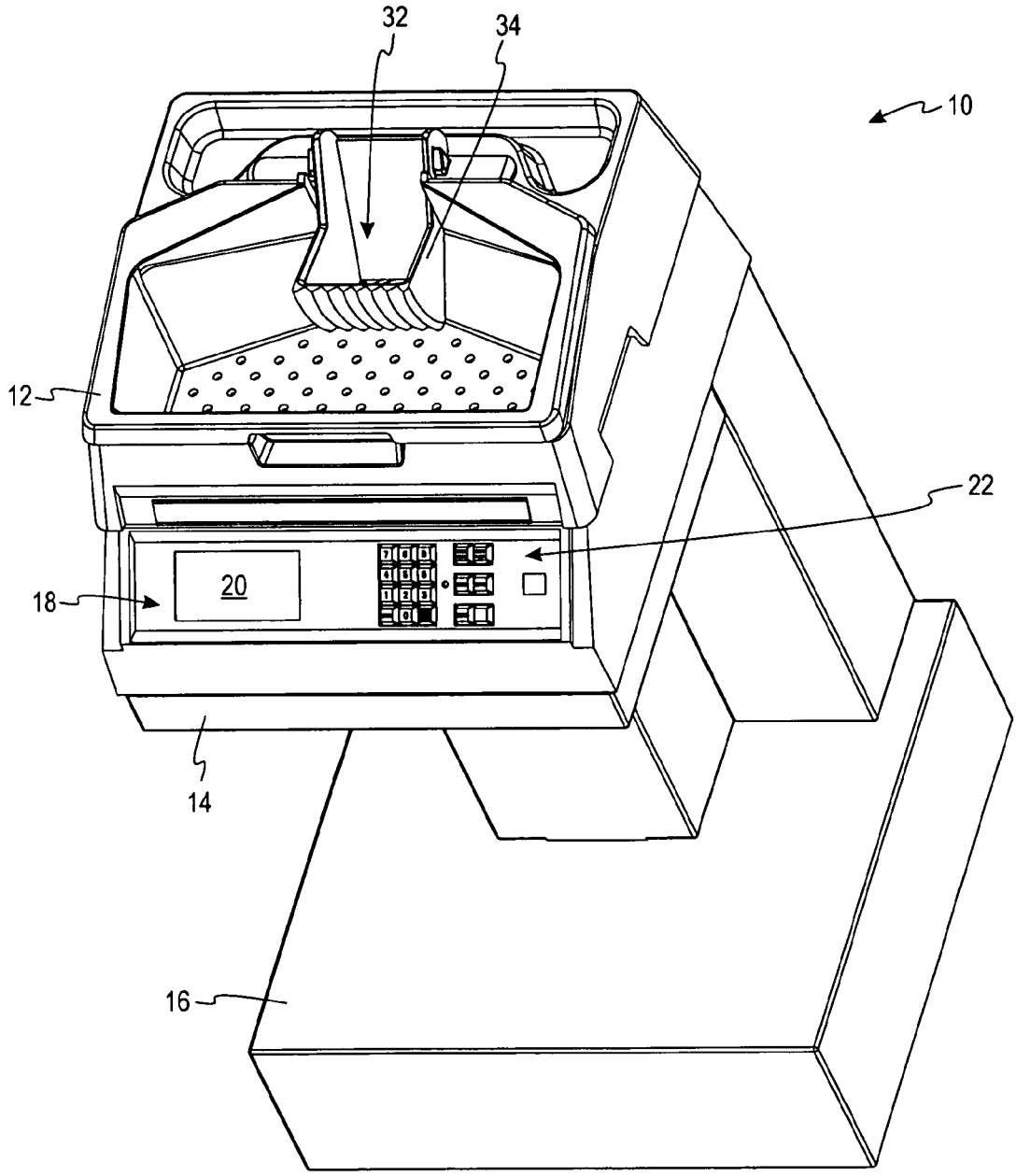
FIG. 1 is a perspective view of a coin processing device according to one embodiment of the present invention.

While the invention is susceptible to various modifications and alternative forms, specific embodiments are shown by way of example in the drawings and will be described in detail herein. It should be understood, however, that the invention is not intended to be limited to the particular forms disclosed.

DETAILED DESCRIPTION OF THE ILLUSTRATED EMBODIMENTS

Turning now to the drawings and referring first to FIG. 1, a coin processing device 10 having a pivoting coin input tray 12 is shown. The coin tray 12 holds coins prior to inputting some or all of the coins in the coin tray 12 to the coin processing device 10. The coin tray 12 transfers the coins by pivoting upward causing coins deposited therein to move, under the force of gravity, to a sorting mechanism (not shown) disposed within a cabinet 14 via a funnel 32 formed by a coin chute 34. The sorting mechanism discharges sorted coins to a plurality of coin bags (not shown), or other coin receptacles, that are suspended from the cabinet 14, the bottoms of the bags may rest upon a platform 16, or may hang from bag holders attached to the cabinet in alternative embodiments of the present invention. In other alternative embodiments of the coin processing device, a gravity feed input tray may be used to funnel coins from a coin receiving area to the coin processing mechanism within the cabinet 14. According to an alternative embodiment of the present invention, the platform 16 is adjustable so that distance between the platform 16 and the cabinet 14 can be varied for accommodating different sized coin bags.

An operator interface 18 interacts with a controller (not shown) of the coin processing device 10. The controller determines the coin totals during sorting, controls the termination of coin sorting (e.g., when a predetermined number of coins have been transferred to a coin bag), and calculates pertinent data regarding the sorted coins. The operator interface 18 includes a display 20 for displaying information to an operator of the coin processing device 10 and a keypad 22 for receiving input from an operator of the coin processing device 10. Input from an operator of the coin sorter 10 can include selection of predefined modes of operation, instructions for defining modes of operation, requests for certain output to be displayed on the display 20 and/or a printer (not shown), identification information such as an identification code for identifying particular transactions or batches of coins, etc. According to an alternative embodiment, the operator interface 18 comprises a touch screen type display/interface.

During consecutive batch sorting operations, an operator dumps coins into the coin tray 12 and inputs an identification number along with any additional data via the interface 18. The operator then transfers the coins within the coin tray 12 to the sorting mechanism. While the coins are being sorted, the operator can dump the next batch of coins into the coin tray 12 and enter data corresponding to the next batch.

Figure 2:
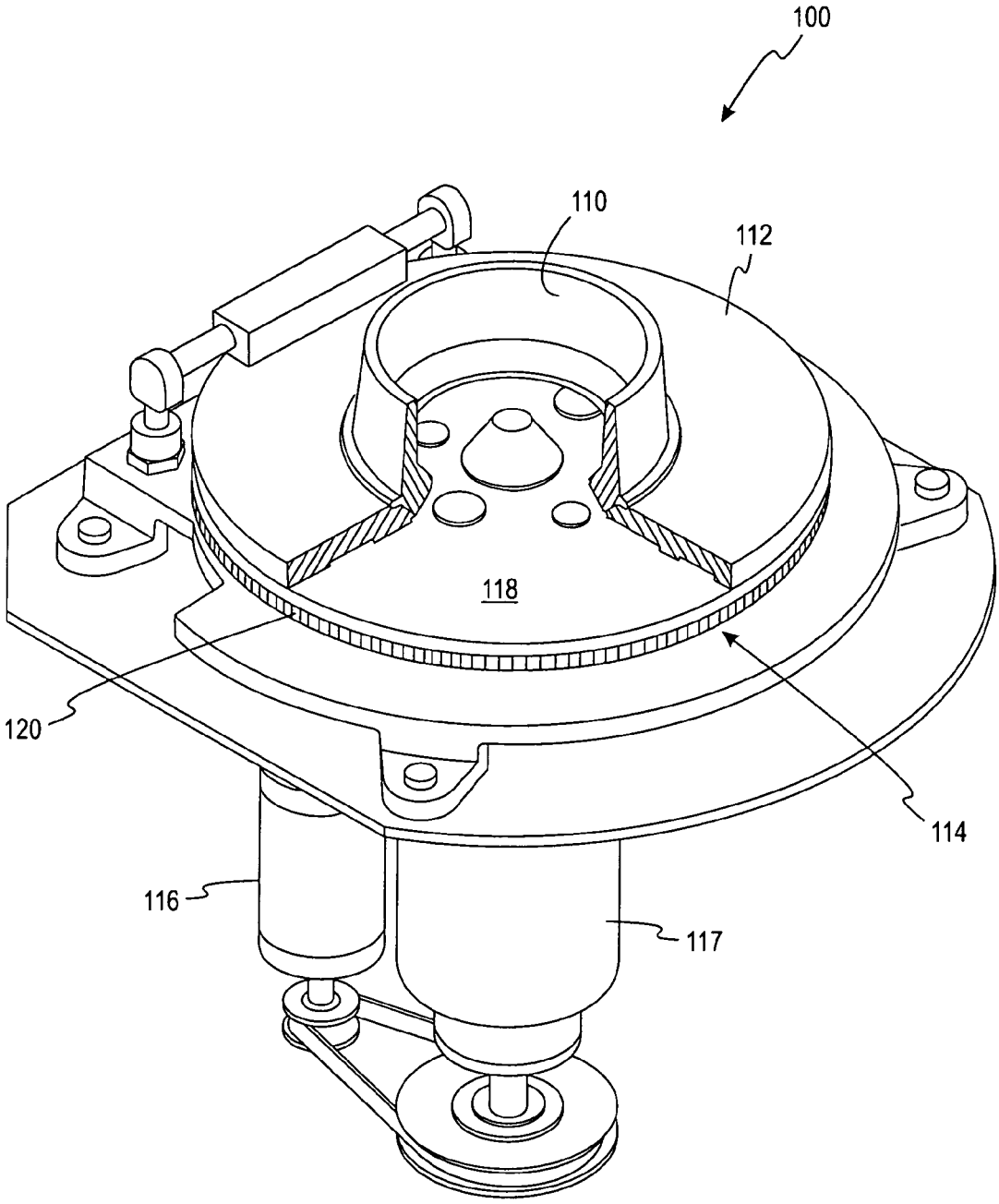
FIG. 2 is a perspective view of a disk-type coin processing unit, having portions thereof broken away to show the internal structure, for use with the coin processing device of FIG. 1 according to one embodiment of the present invention.

Referring now to FIG. 2, a disk-type coin processing unit 100 that is used in the coin processing device 10 of FIG. 1 according to one embodiment of the present invention is shown. The coin processing unit 100 includes a hopper 110 for receiving coins of mixed denominations via the funnel 32 of the coin chute 34, and feeds the coins through a central opening in an annular, stationary sorting head 112. As the coins pass through this opening, the coins are deposited on the top surface of a rotatable disk 114. This rotatable disk 114 is mounted for rotation on a shaft (not shown) and driven by an electric motor 116. The rotation of the rotatable disk 114 is slowed and stopped by a breaking mechanism 117. The disk 114 typically comprises a resilient pad 118, preferably made of a resilient rubber or polymeric material, bonded to the top surface of a solid disk 120. The solid disk 120 is often made of metal, but it can also be made of a rigid polymeric material. According to one embodiment, coins are initially deposited by a user in the coin tray 12 (FIG. 1) disposed above the coin processing unit 100. Coins flow down through the funnel 32 of the coin chute 34 under the force of gravity into the hopper 110.

As the disk 114 is rotated, the coins deposited on the resilient pad 118 tend to slide outwardly over the surface of the pad 118 due to centrifugal force. As the coins move outwardly, those coins that are lying flat on the pad 118 enter the gap between the surface of the pad 118 and the sorting head 112 because the underside of the inner periphery of the sorting head 112 is spaced above the pad 118 by a distance which is about the same as the thickness of the thickest coin. As is further described below, the sorting head 112 includes a plurality of coin directing channels for manipulating the movement of the coins from an entry area to a plurality of exit stations where the coins are discharged. The coin exit stations may sort the coins into their respective denominations and discharge the coins from exit channels in the sorting head 112 corresponding to their denominations.

Figure 3:
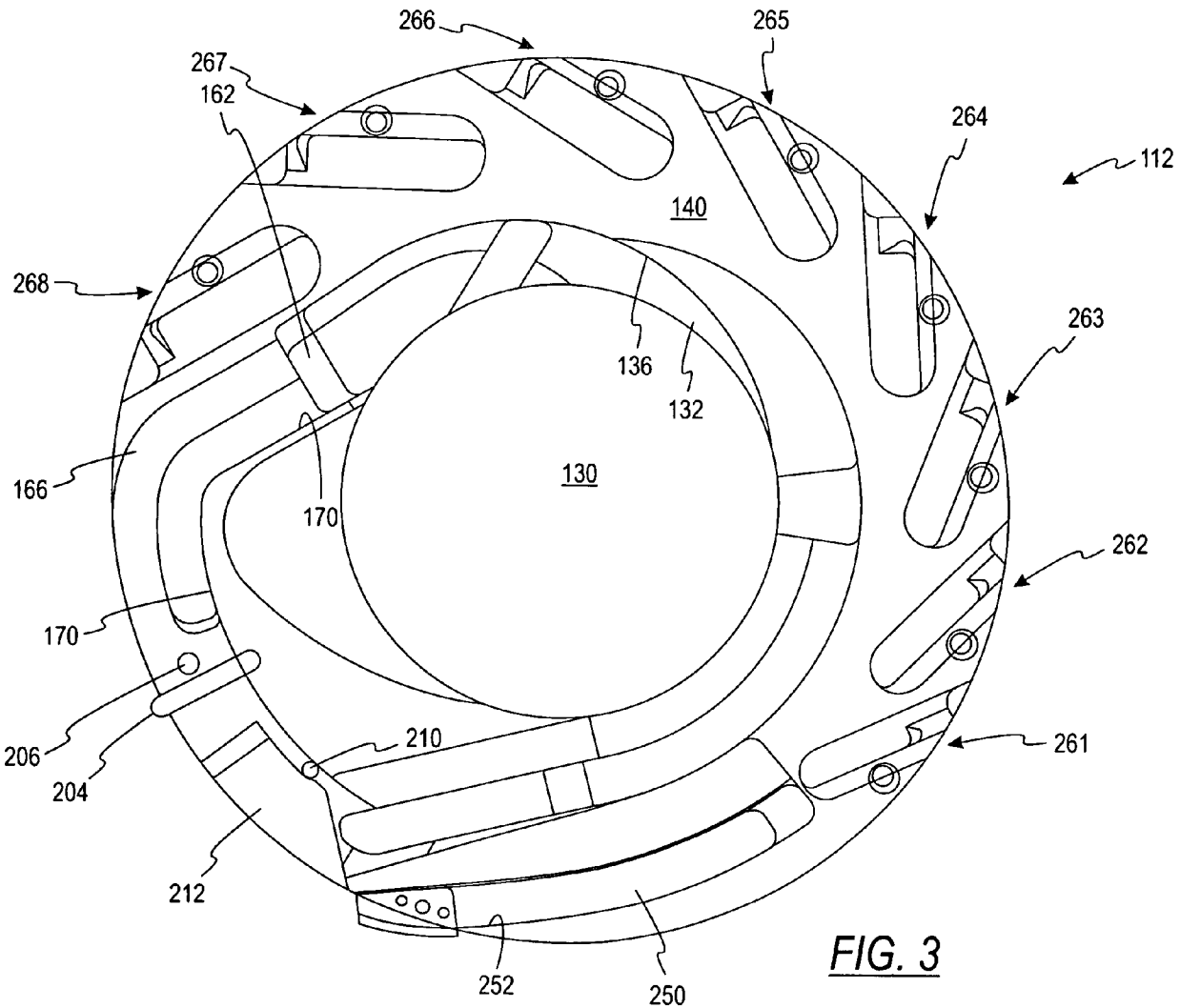
FIG. 3 is an enlarged bottom view of a sorting head for use with the coin processing unit of FIG. 2.

Referring now to FIG. 3, the underside of the sorting head 112 is shown. The coin sets for any given country are sorted by the sorting head 112 due to variations in the diameter size. The coins circulate between the stationary sorting head 112 and the rotating pad 118 (FIG. 2) on the rotatable disk 114 (FIG. 2). The coins are deposited on the pad 118 via a central opening 130 and initially enter the entry channel 132 formed in the underside of the sorting head 112. It should be kept in mind that the circulation of the coins in FIG. 3 appears counterclockwise as FIG. 2 is a view of the underside of the sorting head 112.

An outer wall 136 of the entry channel 132 divides the entry channel 132 from the lowermost surface 140 of the sorting head 112. The lowermost surface 140 is preferably spaced from the pad 118 by a distance that is slightly less than the thickness of the thinnest coins. Consequently, the initial outward radial movement of all the coins is terminated when the coins engage the outer wall 136, although the coins continue to move more circumferentially along the wall 136 (in the counterclockwise direction as viewed in FIG. 3) by the rotational movement imparted to the coins by the pad 118 of the rotatable disk 114.

As the pad 118 continues to rotate, those coins that were initially aligned along the wall 136 move across the ramp 162 leading to the queuing channel 166 for aligning the innermost edge of each coin along an inner queuing wall 170. The coins are gripped between the queuing channel 166 and the pad 118 as the coins are rotated through the queuing channel 166. The coins, which were initially aligned with the outer wall 136 of the entry channel 130 as the coins move across the ramp 162 and into the queuing channel 166, are rotated into engagement with inner queuing wall 170. As the pad 118 continues to rotate, the coins which are being positively driven by the pad move through the queuing channel 166 along the queuing wall 170 past a trigger sensor 206 and a discrimination sensor 204 for discriminating between valid and invalid coins. In other embodiments, the discrimination sensor 204 also determines the denomination of the coins. The trigger sensor 206 sends a signal to the discrimination sensor 204 that a coin is approaching.

Coins determined to be invalid are rejected by a diverting pin 210 that is lowered and impacts an invalid coin to redirect the invalid coin to the reject channel 212 which guides the rejected coins to a reject chute (not shown) that return the coin to the user. The diverting pin 210 remains in its home, or nondiverting position, until an invalid coin is detected. Those coins not diverted into the reject channel 212 continue along inner queuing wall 170 to the gauging region 250. The inner queuing wall 170 terminates just downstream of the reject channel 212; thus, the coins no longer abut the inner queuing wall 170 at this point and the queuing channel 166 terminates. The radial position of the coins is maintained, because the coins remain under pad pressure, until the coins contact an outer wall 252 of the gauging region 250.

The gauging wall 252 aligns the coins along a common radius as the coins approach a series of coin exit channels 261-268 which discharge coins of different denominations. The first exit channel 261 is dedicated to the smallest coin to be sorted (e.g., the dime in the U.S. coin set). Beyond the first exit channel 261, the sorting head 112 shown in FIG. 3 forms seven more exit channels 262-268 which discharge coins of different denominations at different circumferential locations around the periphery of the sorting head 112. Thus, the exit channels 261-268 are spaced circumferentially around the outer periphery of the sorting head 112 with the innermost edges of successive channels located progressively closer to the center of the sorting head 112 so that coins are discharged in the order of increasing diameter. The number of exit channels can vary according to alternative embodiments of the present invention.

The innermost edges of the exit channels 261-268 are positioned so that the inner edge of a coin of only one particular denomination can enter each channel 261-268. The coins of all other denominations reaching a given exit channel extend inwardly beyond the innermost edge of that particular exit channel so that those coins cannot enter the channel and, therefore, continue on to the next exit channel under the circumferential movement imparted on them by the pad 118. To maintain a constant radial position of the coins, the pad 118 continues to exert pressure on the coins as they move between successive exit channels 261-268.

Further details of the operation of the sorting head 112 shown in FIG. 3 are disclosed in U.S. Patent Application Publication No. US 2003/0168309 A1 ("Disk-Type Coin Processing Device Having Improved Coin Discrimination System"), which is incorporated herein by reference in its entirety. Other disk-type coin processing devices that may be used with the coin processing device of FIG. 1 are described in detail in U.S. Pat. Nos. 5,865,673 and 5,997,395, each of which is incorporated herein by reference in its entirety.

As discussed in the Background Section, when the coin processing device 10 is disposed in a retail setting for use as a retail coin redemption machine, the coin processing unit 100 (FIG. 2) is disposed within a secure housing to prevent unauthorized access to the coins. The housing, however, makes it difficult, or at least cumbersome, to access the coin receptacles (e.g., coin bags) that hold the sorted coins. The bags are disposed around the outer periphery of the sorting head 112 such that, when viewed from the front of the housing, some bags are disposed substantially behind others. Thus, the operator must reach far back into the coin processing device to access those coin bags not disposed toward the front of the device.

Figure 4A:
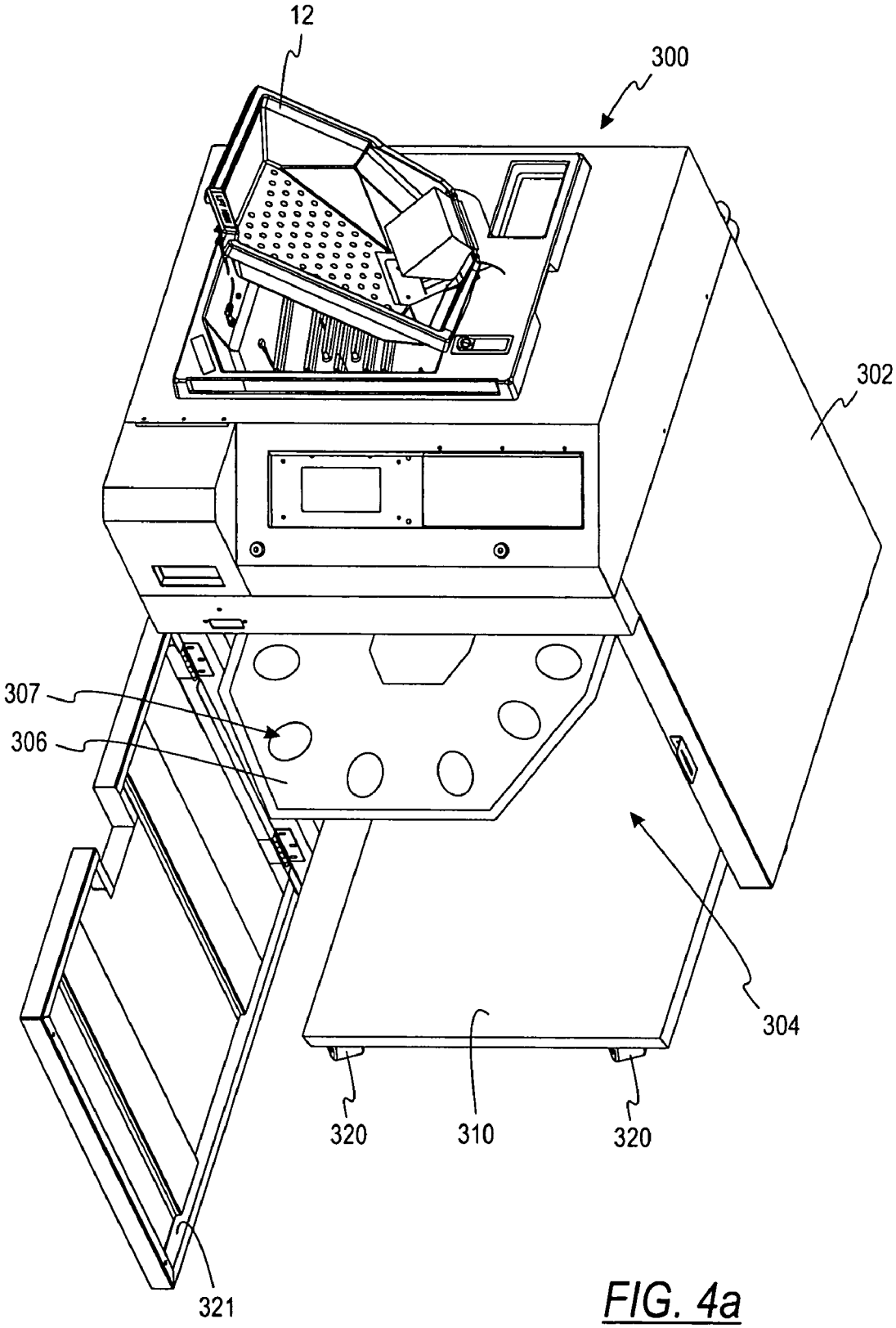
FIG. 4*a* is a perspective view of a coin processing device having a moveable coin receptacle station according to one embodiment of the present invention.
Figure 4B:
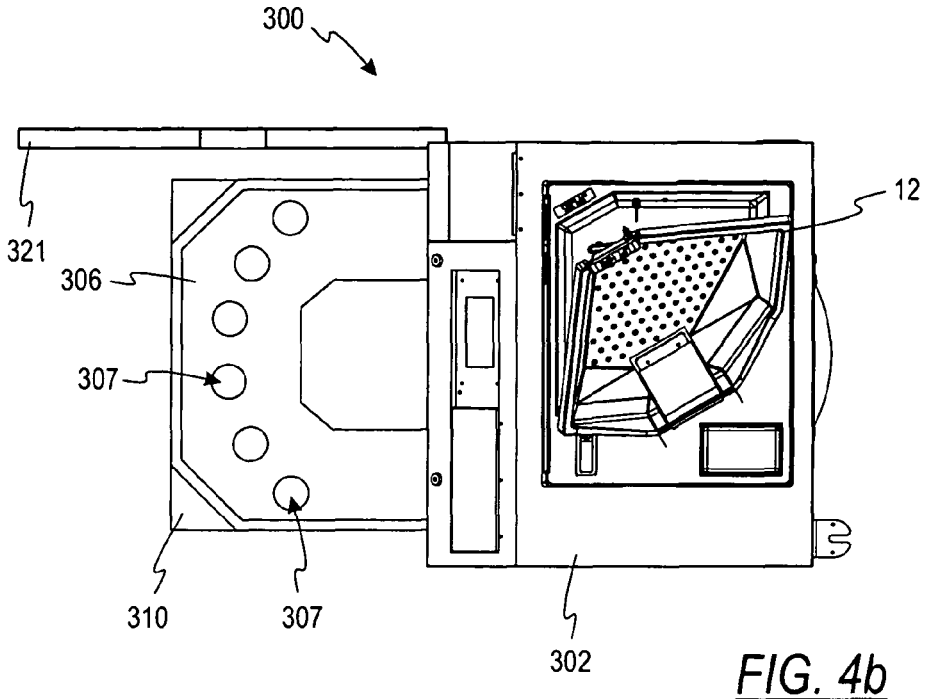
FIG. 4*b* is a top view of a coin processing device of FIG. 4*a*.
Figure 4C:
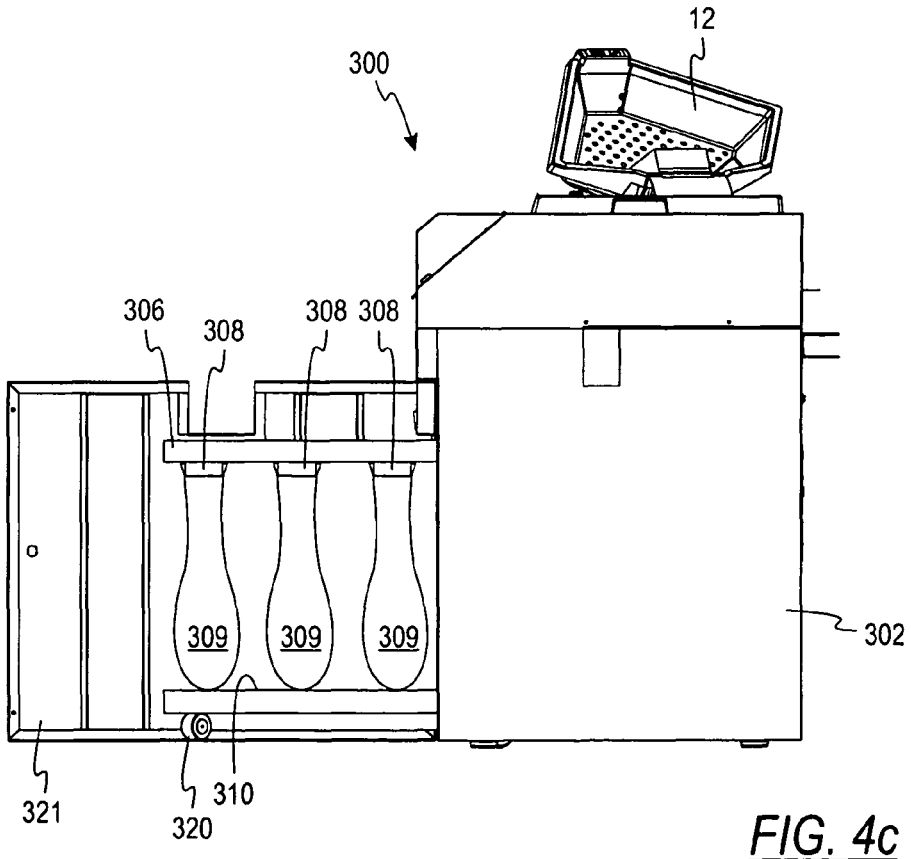
FIG. 4*c* is a side view of a coin processing device of FIG. 4*b*.

Referring now to FIGS. 4*a*, 4*b*, and 4*c*, a coin processing device 300 having a coin-storage system for providing greater access to coin bags is shown. The coin processing device 300 includes a housing 302 that contains a coin processing unit 100 (FIG. 2). Also disposed within the housing 302, is a moveable bag receptacle station 304 that travels into and out of the housing 302 to facilitate an operator's access to coin receptacles, including coin bins and coin bags that contain sorted coins.

The receptacle station 304 includes a manifold 306 for directing coins discharged from the exit channels 261-268 of the sorting head 112 (FIG. 3) into coin bags 309 attached to bag holders 308 (FIG. 4*c*), which are attached to an underside of the manifold 306. The manifold 306 is disposed below the coin sorting unit 100 (FIG. 2) and receives sorted coins via a plurality of apertures 307. A bag holder suitable for use with the present invention is described in U.S. Pat. No. 6,131,625 ("Coin Bag Clamping Device"), which is incorporated herein by reference in its entirety. The open end of a coin bag 309 is attached to the bag holder 308, while the closed end of the coin bag 309 may rest on a platform 310 of the receptacle station 304. Some embodiments of the present invention include dual-bag holders for holding two coin bags per coin denomination sorted. The coin processing device 300 switches from directing sorted coins of one denomination into a first coin bag to directing coins to a second coin bag after the first coin bag is filled. According to an alternative embodiment of the present invention, the platform 310 is adjustable so that distance between the platform 310 and the manifold 306 can be varied for accommodating different sized coin bags.

While the receptacle station 304 has been shown and described thus far as being disposed on casters 320, other mechanisms may be implemented for facilitating the movement of the coin receptacle station 304 into and out of the housing 302 of the coin processing device 300 in various alternative embodiments of the present invention. For example, the moveable receptacle station 304 may be disposed on a glide unit, a cart, railings, or a drawer that slides into and out of the of the housing 302 of the coin processing device 300. In other alternative embodiments, the moveable receptacle station 304 is disposed on wheels or rollers that move along a track disposed with in the housing 302.

The receptacle station 304 is disposed on wheels or casters 320 for facilitating the movement of the receptacle station 304 into and out of the housing 302. In other alternative embodiments, the receptacle station 304 rolls on one or more tracks disposed within the housing. According to one embodiment of the present invention, a damping mechanism is attached to the receptacle station 304 for controlling the speed at which the receptacle station 304 travels as it travels into and out of the housing 302. A first end of the damping mechanism is coupled to the coin receptacle station 304 and a second end of the damping mechanism is coupled to the housing 302. Especially when loaded with semi-full coin bags, the amount of weight traveling with the receptacle station 304 is considerable. The damping mechanism, such as an air cylinder, prevents the moveable receptacle station 304 from traveling too rapidly into and out of the housing 302.

The moveable receptacle station 304 facilitates operator access to the coin bags 309. In operation, the receptacle station 304 is moved into the housing 302 of the coin processing device 300 and a door 321 prevents unauthorized access to the coin bags 309. At certain times or upon the occurrence of certain events, such as a coin bag 309 becoming filled, an operator accesses the coin bags 309. In doing so, the operator opens the door 321 and moves the coin receptacle station 304 from an operating position, wherein the coin receptacle station 304 is entirely contained within the housing 302, to an accessible position extending out of the housing 302 as shown in FIGS. 4*a*-*c*. When the receptacle station 304 is in the accessible position, the operator can more easily access all of the coin bags 309 containing sorted coins.

In an alternative embodiment of the present invention, coin receptacles such as bins or boxes may be used for holding sorted coins rather than coin bags 309. The coin bins or boxes are disposed on the platform 310 of the coin receptacle station 304. Alternatively still, coin bags may line the coin bins.

In yet other alternative embodiments of the present invention, the bag receptacle station 304 may comprise a plurality of denomination-specific drawers that individually slide out from the housing 302 for unloading a particular coin denomination from the coin processing device 300. The individual drawings can include coin receptacles, such as one or more bins, that can be lined with coin bags for collecting the sorted coins. In embodiments where coin bins are disposed on individual drawers (FIG. 6), or on the single platform 310, the manifold 306 does not need to also slide out of the housing 302.

Figure 5A:
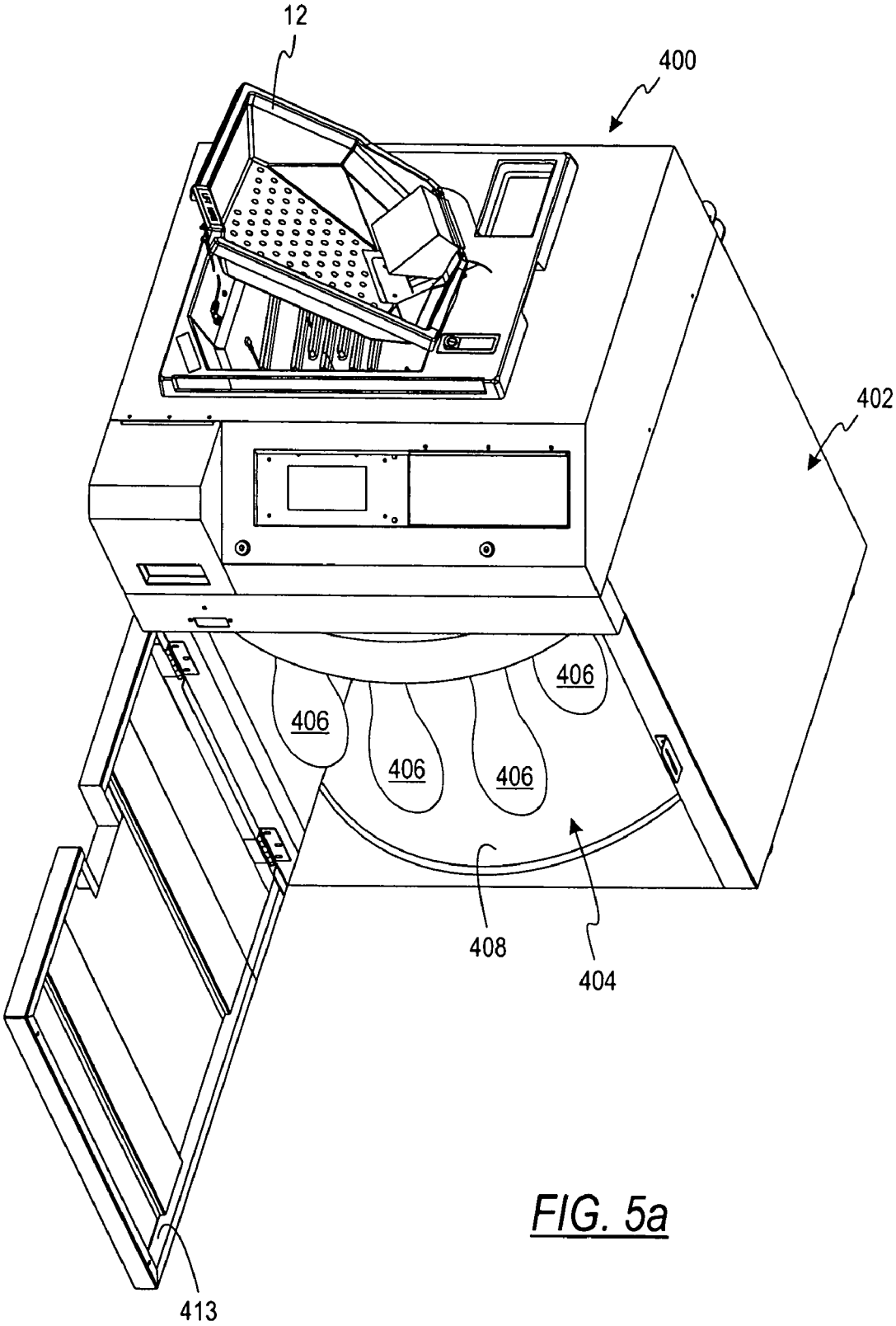
FIG. 5*a* is a perspective view of a coin processing device having a rotatable coin receptacle station according to one embodiment of the present invention.
Figure 5B:
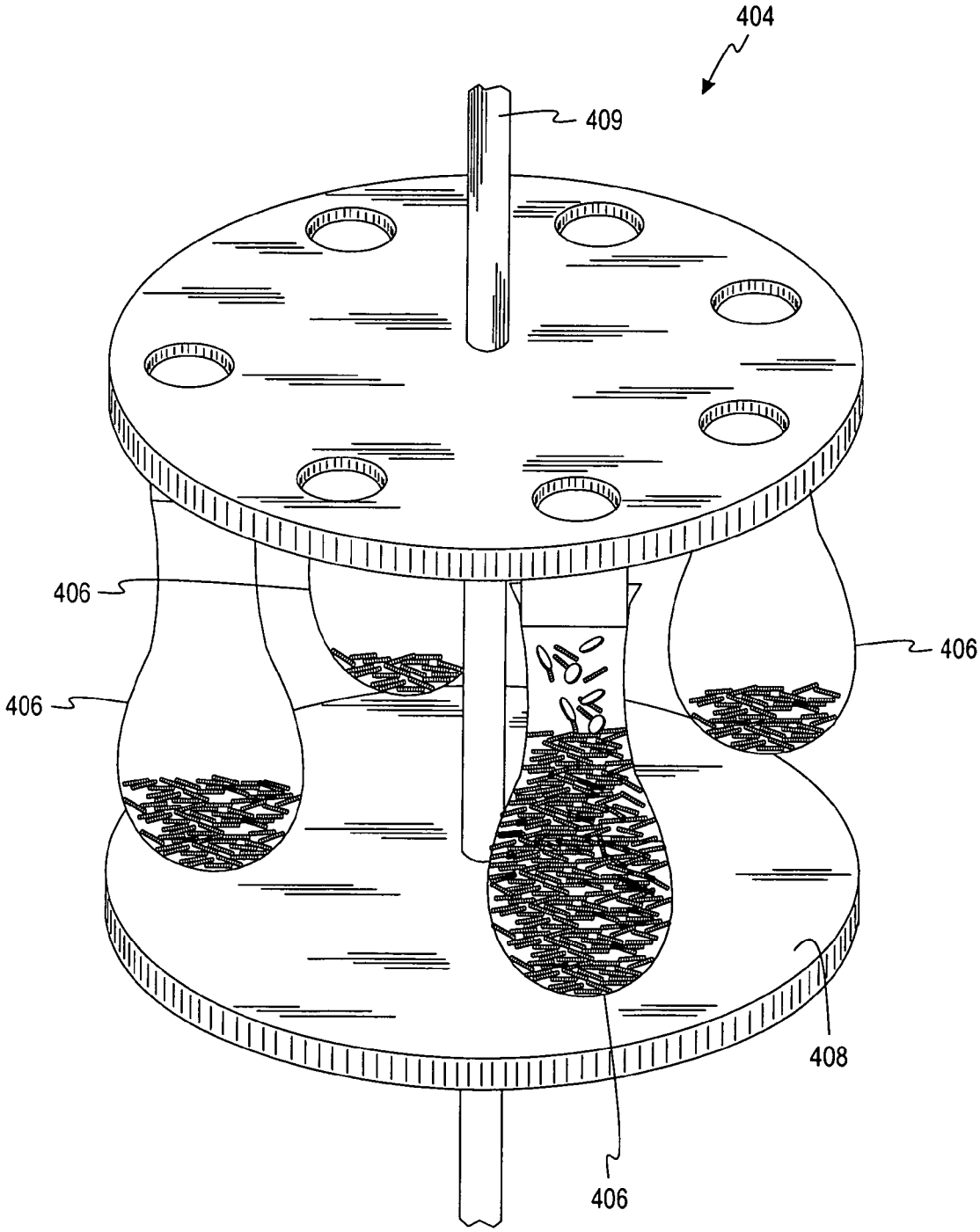
FIG. 5*b* is a perspective view of a rotatable coin receptacle station for use with the coin processing device of FIG. 5*a*.

Referring to FIGS. 5*a* and 5*b*, a coin processing device 400 having a coin-storage system for providing greater access to coin bags is shown according to an alternative embodiment of the present invention. The coin processing device 400 includes a housing 402 that contains a coin processing unit 100 (FIG. 2). Also disposed within the housing, is a rotatable bag receptacle station 404 that rotates within the housing to facilitate an operator's access to coin bags 406 suspended from receptacles, including coin bins and coin bags for containing sorted coins.

The rotatable bag station 404 is disposed below the coin processing unit 100 (FIG. 2) of the coin processing device and includes a plurality of apertures 405 (FIG. 5*b*) that direct coins discharged from the sorting head 112 (FIG. 3) into coin bags 406 suspended from bag holders (not shown) attached to the underside of the rotatable bag station 404. The closed ends of the coin bags 406 rest on a platform 408 of the rotatable bag station 404, which also rotates. The rotatable bag station 404 and platform 408 are attached to a vertical axle 409 about which the rotatable bag station 404 rotates. Alternatively, the rotatable bag station 404 is disposed on a plurality of bearings that allow the station 404 to rotate. The rotatable bag station 404 permits an operator to access each of the coin bags 406 from the front of the coin processing device 400 after opening a door 413. The operator rotates the bag station 404 to the front of the housing 402 of the coin processing device 400 in order to access each of the bags 406 disposed around the bag station 404. According to an alternative embodiment of the present invention, the platform 408 is adjustable so that distance between the platform 408 and the bag holders can be varied for accommodating different sized coin bags. In yet another alternative embodiment of the present invention, the rotatable bag station 404 is adapted to slide out of the housing 402 of the coin processing device 400 as well as to rotate for providing access to the sorted coins.

In an alternative embodiment of the present invention, the rotatable bag station 404 includes a plurality of coin bag partitions (not shown) disposed on the platform 408. The coin bag partitions prevent the coins bags 406 from interfering with adjacent bags 406 as the coin bags 406 become filled. For example, without coin bag partitions, a first coin bag 406 that is filling up at a faster rate than an adjacent coin bag 406 may "bulge out" and contact the adjacent coin bag, which may prevent the adjacent coin bag from filling properly.

In an alternative embodiment of the present invention, the rotatable bag station 404 is rotated by a motor. The operator can control the rotation of the bag station 404 via the interface 18 (FIG. 1). Alternatively, the rotatable bag station 404 automatically rotates—automatically indexes—to present a filled coin bag 406 at the front of the housing 402 of the coin processing device 400 for operator access.

Figure 5C:
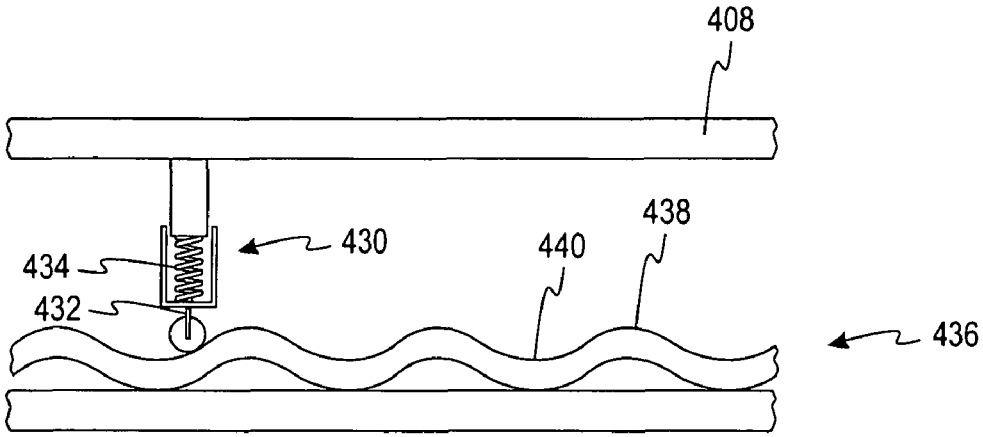
FIG. 5*c* is a side view of a damping mechanism for use with the coin processing device of FIG. 5*a*

Referring now to FIG. 5*c*, according to one embodiment of the present invention, a damping mechanism 430 is coupled to the underside of the rotatable bag station platform 408 to inhibit free rotation of the bag receptacle station 404. The damping mechanism 430 includes a spring loaded roller 432. An internal spring 434 downwardly forces the roller onto a generally-sinusoidal-shaped track 436 that is disposed within the coin sorting mechanism housing 402 below the platform 408. The track 436 comprises a plurality of peaks 438 and valleys 440, wherein the number of valleys 440 corresponds to the number of coin bags 406 (FIGS. 5*a,b*) attached to the rotatable bag station 404. In alternative embodiments of the present invention, locations of the track 436 and spring loaded roller 432 may be switched such that the track 436 is disposed on the underside of the platform 408 and the spring loaded roller 432 is attached to the housing of the coin processing device. Alternatively still, the roller may be air filled or hydraulic, rather than spring-loaded.

As an operator manually turns the rotatable bag station 404, the spring loaded roller 430 travels over the peaks 438 in the track 436. The spring 434 in the spring loaded roller 436 compresses and the roller 432 travels over a peak 438 thus increasing the force required to turn the rotatable bag station 404. This arrangement inhibits the rotatable bag station 404 from rotating a distance corresponding to one bag at a time. Due to the considerable weight of the rotatable coin station, due in large part to the weight of the coins, the damping mechanism 430 inhibits continued rotation of the rotatable coin station due to the momentum of the rotatable bag station 404.

In other alternative embodiments of present invention, other mechanisms are used to inhibit the free rotation of the rotatable bag station 404. For example, in one alternative embodiment, a braking mechanism prohibits the rotatable bag station 404 from rotating more than one coin bag position at a time. In other alternative embodiments of the present invention that implement a motor for turning the rotatable bag station 404, the motor controls the rotation of the rotatable bag station 404, thus prohibiting free rotation of the rotation bag station 404. In still other alternative embodiments, the damping mechanism 430 may comprise an air or hydraulic cylinder.

Figure 6:
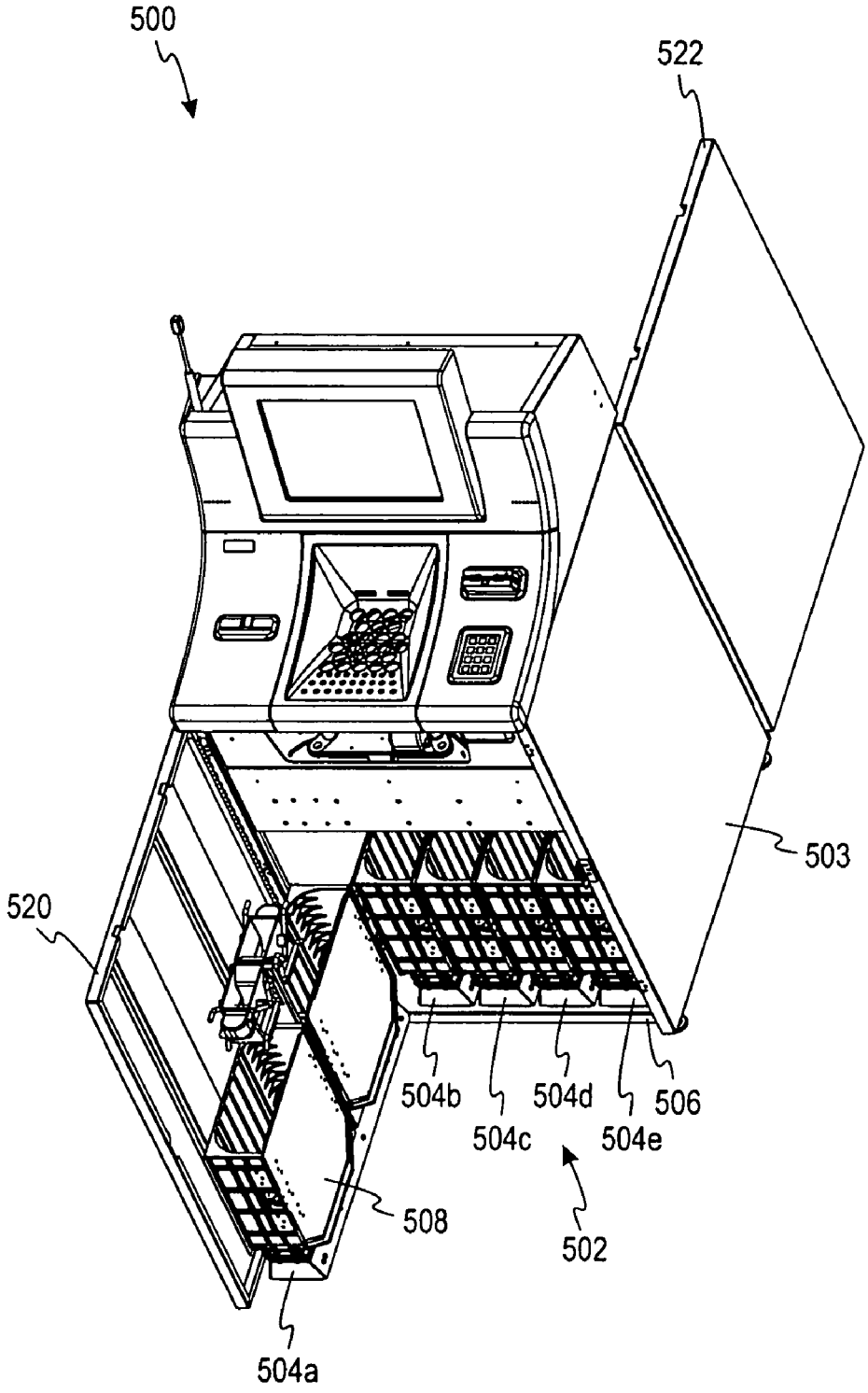
FIG. 6 is a front perspective view of a coin processing device having a moveable coin receptacle station according to one embodiment of the present invention.
Figure 7:
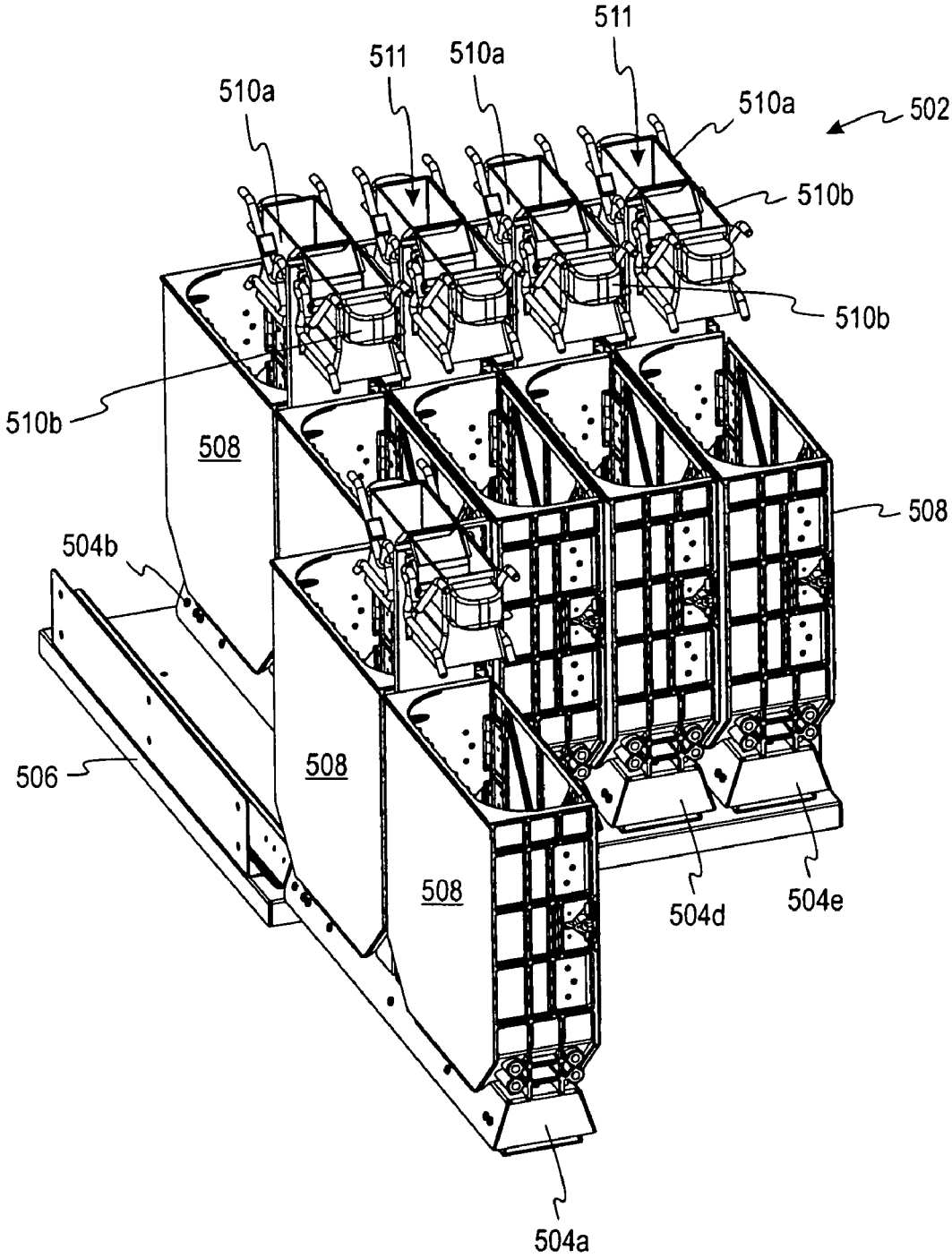
FIG. 7 is a perspective view of the moveable coin receptacle station of FIG. 6.

Turning to FIG. 6, a coin processing device 500 having a moveable coin receptacle station 502 disposed within a housing 503 of the coin processing device 500 is shown according to an alternative embodiment of the present invention. FIG. 7 shows the coin receptacle station 502 removed from the housing 503 of the coin processing device 500. The coin receptacle station 502 includes a plurality of moveable coin-receptacle platforms 504*a-e* ("moveable platforms") having coin receptacles disposed thereon. Each of the moveable platforms 504 is slideably attached to a base 506 that may be disposed on the ground beneath the coin processing device 500 and within the housing 503, be mounted to the housing 503, or a combination thereof.

The coin receptacles that the illustrated coin receptacle station 502 is designed to accommodate are coin bags. Each of the platforms 504*a-e* include coin bag partitions 508 that partition coin bags from adjacent coin bags for preventing coin bags from contacting adjacent coin bags and disrupting the flow of coins into the coin bags as discussed above. In the illustrated embodiment, each moveable platform 504 includes two coin bag partitions 508. In other embodiments, each moveable platform 504 may only include one coin bag partition 508, or may include more than two coin bag partitions 508. Alternatively still, the moveable platforms 504 may have one or more of other types of coin receptacles such as coin bins, for example, disposed thereon. The coin receptacle station 502 also includes two bag holders or bag clamping mechanisms 510*a,b* corresponding to each of the two coin bag partitions 508 for each moveable platform 504. Each bag clamping mechanism 510 positions the opening of a coin bag for receiving processed coins. The coin bag holders 510 include a funnel-like guide 511 for directing coins into the held coins bags.

According to one embodiment of the present invention, the number of moveable platforms 504 corresponds to the number of coin denominations to be processed. For example, in the U.S. coin set, dimes are directed to the coin receptacles disposed on the first moveable platform 504*a*, nickels are directed to the coin receptacles disposed on the second moveable platform 504*b*, dimes are directed to the coin receptacles disposed on the third moveable platform 504*c*, quarters are directed to the coin receptacle disposed on the fourth moveable platform 504*d*, and half-dollar or dollar coins are directed to the coin receptacles disposed on the fifth moveable platform 504*e*. In other embodiments, coins can be routed to the coin receptacles on the moveable platforms 504 in a variety of manners. For example, in the illustrated configuration, if the operator of the coin processing system 500 is anticipating a larger number of quarters, three of the coin receptacles on the moveable platforms 504 may be used for receiving quarters and only one receptacle is used for receiving coins of another denomination. And, for example, half-dollar coins can be routed to one of the coin receptacles disposed on the fifth moveable platform, and dollar coins can be routed to the other coin receptacle disposed on the fifth moveable platform in an alternative embodiment of the present invention.

In operation, an operator of the coin processing device 500 that desires to access the coin receptacles first opens a front door 520 of the housing 503 to access the coin receptacles. Depending on which coin receptacles the operator needs to empty, the operator slides out one of the moveable platforms 504 at a time (as shown in FIG. 6) to access coins contained in the coin receptacles disposed thereon. If coin bags are used, for example, the operator may replace filled coin bags in the coin bag partitions 508 with empty coin bags.

Figure 8:
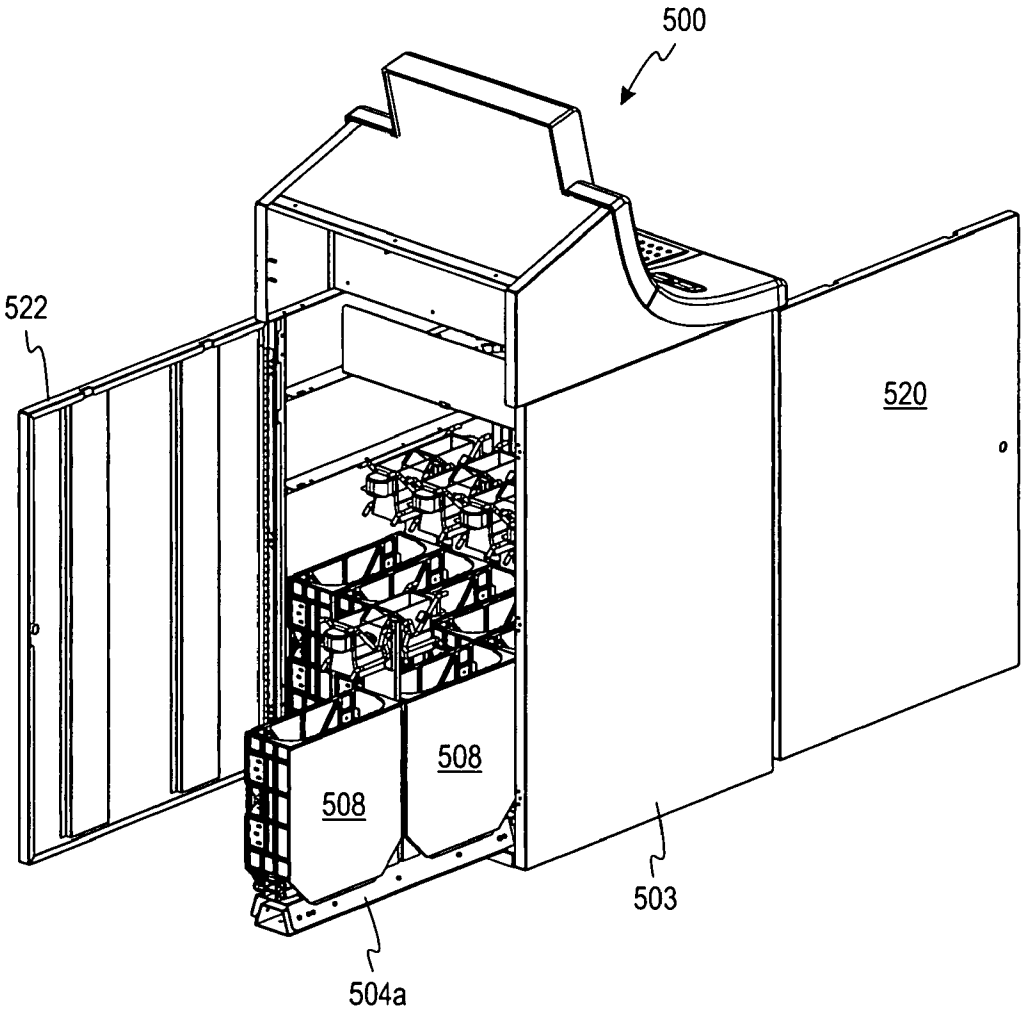
FIG. 8 is a rear perspective view of the coin processing device of FIG. 6.

Turning to FIG. 8, the housing 503 of the coin processing device 500 is provided with a rear door 522, which allows an operator more flexibility in accessing the coins. In some applications, or depending on the physical location of the coin processing device 500, it may be desirable for an operator to access the coin receptacles from the rear of the coin processing device 500. As shown in FIG. 8, the moveable platforms 504 are each moveable out of the rear of the housing 503 of the coin processing device 500 for permitting the operator to access the coin receptacles disposed on the moveable platforms 504.

Figure 9:
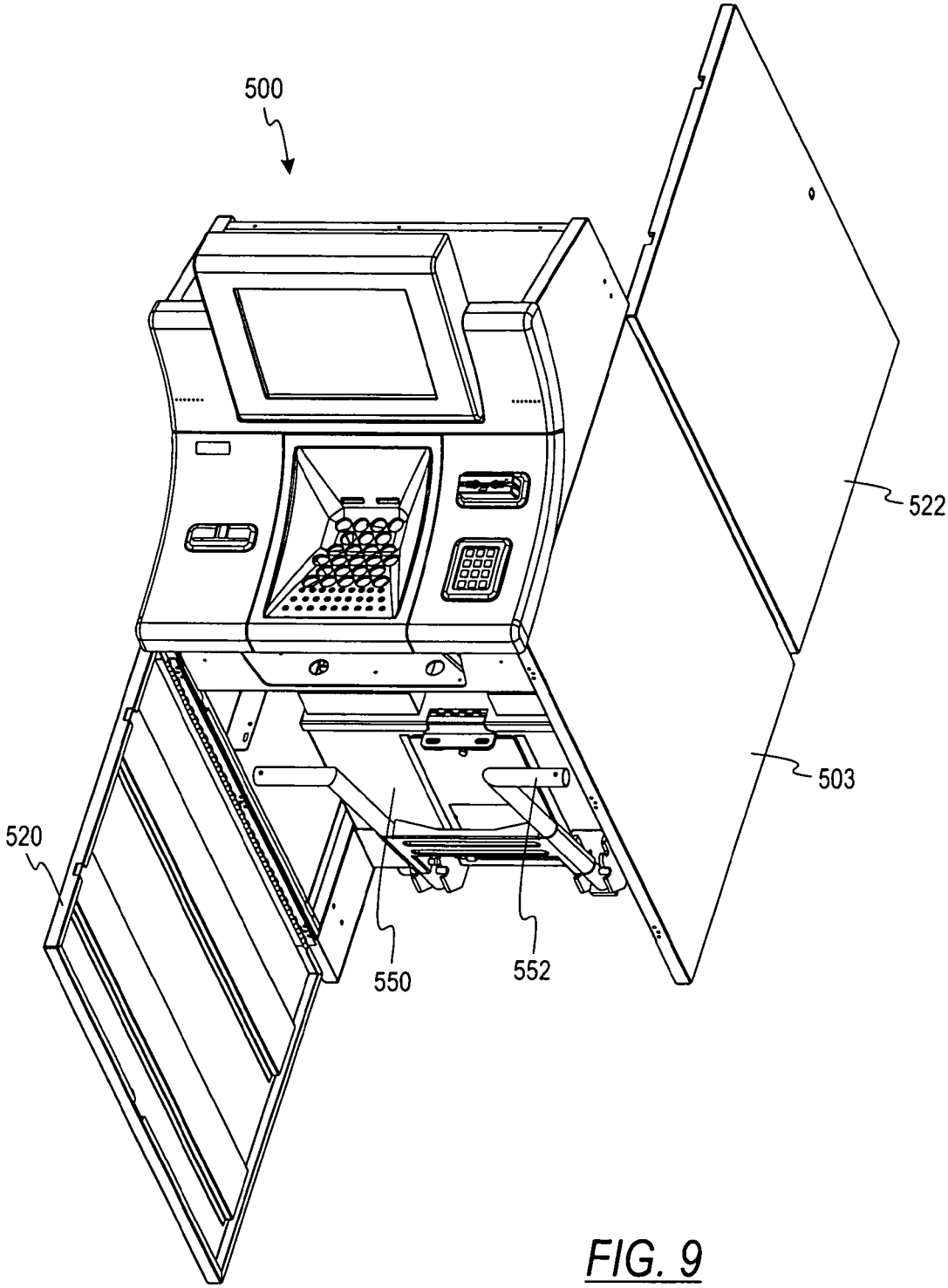
FIG. 9 is a front perspective view of a coin processing device having a moveable coin bin according to one embodiment of the present invention.

Turning to FIG. 9, the coin processing device 500 includes a coin bin 550 disposed within the housing 503. In some applications, it may not be desirable or necessary to sort the coins into individual coin receptacles according to denomination. Rather, all the processed coins are commingled in the coin bin 550. The coin bin 550 is disposed on wheels and includes a telescoping handle 552 pivotally attached thereto for pulling the coin bin 550 from within the housing 503. The coin bin 550 can be accessed via the front door 520 and/or the rear door 522 of the coin processing device 500. Exemplary coin bins that may be used with the coin processing device 500 are described in U.S. patent application Ser. No. 10/251,211 ("Removable Coin Bin"), which was filed on Sep. 20, 2002; and in U.S. Provisional 60/511,039 ("Coin Bin Having Security Feature For Use with A Coin Processing Device"), which was filed on Oct. 14, 2003; each of which is incorporated herein by reference in its entirety.

The coin processing device 500 may include a moveable coin receptacle station 502 having a plurality of movable platforms 504*a-e* having coin receptacles disposed thereon as described in FIG. 6 or may include a moveable coin bin 550 as described in connection with FIG. 9. Alternatively, the coin processing device 500 may include a coin receptacle station 304 that permits an operator to move all the coin receptacles for each coin denomination into and out of the housing of the coin processing device 500 as shown in FIG. 4*a-c*. The same coin processing device 500 can be configured for use with any one of the above-described coin receptacle configurations (e.g., the coin receptacle station 304 of FIGS. 4*a-c*, the coin receptacle station 502 of FIG. 6, or the coin bin 550 of FIG. 9) depending on the needs of the particular application. This modularity—being capable of having a moveable coin receptacle station 502 or a coin bin 550—allows the manufacturer to provide a coin processing device more suited to the needs of a particular customer.

While the invention is susceptible to various modifications and alternative forms, specific embodiments thereof have been shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. A coin processing device, comprising:

a housing;

a coin sorter disposed within the housing, the coin sorter comprising:

an input hopper for receiving coins of a plurality of denominations to be sorted, a rotatable disk for imparting motion to the plurality of coins, and a stationary head having a lower surface generally parallel to and spaced slightly away from the rotatable disk, the lower surface having a plurality of shaped regions for controlling movement of the coins and guiding coins to a plurality of exit channels for discharging coins, the plurality of coin exit channels corresponding to a plurality of coin denominations to be processed, a coin receptacle station disposed within the housing for holding a plurality of coin receptacles, each of the plurality of receptacles for holding coins of a single denomination, the coin receptacle station being moveable between a first position and a second position, the coin receptacle station being disposed entirely within the housing for receiving coins when in the first position, the coin receptacle station having a manifold including a plurality of coin paths for guiding coins from the exit channels to the coin receptacles when the coin receptacle station is in the first position, the coin receptacle station extending out of the housing when in the second position; and a dampening mechanism configured to exert a damping force on the coin receptacle station during movement of the coin receptacle from the first position to the second position and from the second position to the first position.

2. The coin processing device of claim 1, wherein the coin receptacle station includes a plurality of casters, the coin receptacle station being adapted to roll on the plurality of casters when moving between the first position and the second position.

3. The coin processing device of claim 1, wherein the coin receptacles comprise coin bags, the coin receptacle station including a plurality of coin bag holders.

4. The coin processing device of claim 1, wherein the dampening mechanism comprises a first end coupled to the housing and a second end coupled to the coin receptacle station.

5. A coin processing machine, comprising:

a housing containing a coin processing device;

a coin processing unit disposed within the housing, the coin processing unit adapted to process received coins of a plurality of denominations and to discharge processed coins into a plurality of coin receptacles;

a coin receptacle station disposed within the housing for holding a plurality of coin receptacles, the coin receptacle station including a plurality of individually moveable platforms each having at least one coin receptacle disposed thereon, each moveable platform being moveable between a first position and a second position, each moveable platform being disposed entirely within the housing for receiving coins in the at least one coin receptacle disposed thereon when in the first position, each moveable platform extending out of the housing when in the second position, and a track along which each moveable platform slides when moving from the first position to the second position and from the second position to the first position, wherein each of the moveable platforms is at least substantially centered directly over a corresponding track.

6. The coin processing device of claim 5, wherein the coin receptacles are coin bags.

7. The coin processing device of claim 5, wherein the coin processing unit comprises a coin sorter having a plurality of coin exit channels for discharging sorted coins.

8. The coin processing device of claim 7, wherein the coin receptacle station comprises a manifold having a plurality of coin paths for directing coins discharged from the plurality of exit channels to the plurality of coin receptacles.

9. The coin processing device of claim 8, wherein the coin receptacles are coin bins.

10. The coin processing device of claim 8, wherein the coin receptacles are coin bags.

11. The coin processing device of claim 10, wherein each of the moveable platforms include at least one coin bag partition for separating the coin bags.

12. The coin processing device of claim 10 wherein the coin receptacle station includes a plurality of coin bag holders disposed proximate exits of the plurality of coin exit channels.

13. The coin processing device of claim 5, wherein the housing further comprises a door moveable between an open position and a closed position to permit a moveable platform to move relative to the door from the first position to the second position when the door is in the open position.

14. The coin processing device of claim 13, wherein the door is disposed on the front side of the housing.

15. The coin processing device of claim 13, wherein the door is disposed on the rear side of the housing.

16. A method for processing coins with a coin processing machine comprising a housing, a coin sorting unit disposed within the housing, and a plurality of moveable coin receptacle platforms each bearing at least one coin receptacle, the coin receptacle platforms each being disposed over a track and each being independently moveable on the track, each moveable coin receptacle platform being disposed entirely within the housing for receiving coins when in a first position, the method comprising:

receiving in a coin input region a plurality of coins of a plurality of predetermined denominations;

sorting the plurality of coins according to denomination with the coin sorting unit;

directing sorted coins to the plurality of coin receptacles;

determining, using a controller, if a predetermined number of coins have been discharged to one of the coin receptacles;

automatically terminating coin sorting when said controller determines that a predetermined number of coins have been discharged to said one coin receptacle;

sliding the moveable coin receptacle platform bearing said one coin receptacle along the track from the first position to permit access to said one coin receptacle;

removing coins from said one coin receptacle; and sliding said moveable coin receptacle platform back to the first position along the track.

17. The method of claim 16, further comprising:

opening a door of the housing prior to moving any coin receptacle platform;

moving, only subsequent to the opening of the door of the housing, a coin receptacle platform from the first position.

18. A coin processing device, comprising:

a housing;

a coin sorting unit disposed within the housing, the coin sorting unit being configured to sort a batch of coins and discharge the sorted coins according to denomination;

a coin receptacle area comprising a coin receptacle station disposed within the housing for holding a plurality of coin receptacles each for receiving discharged coins of a single denomination, the coin receptacle station including a plurality of individually moveable platforms each having at least one coin receptacle disposed thereon, each moveable platform being moveable between a first operable position and a second inoperable position, each moveable platform being disposed entirely within the housing for receiving coins in the at least one coin receptacle disposed thereon when in the first operable position, each moveable platform extending out of the housing when in the second inoperable position, and a plurality of tracks, each of the plurality of individually moveable platforms being fixedly connected to a respective one of the plurality of tracks and being physically constrained to slide only from said first operable position to said second inoperable position and from said second inoperable position to said first operable position along a corresponding one of said plurality of tracks.

19. The coin processing device of claim 18, wherein the coin receptacles comprise coin bags.

20. The coin processing device of claim 18, further comprising at least one coin bag partition disposed on each of the moveable platforms.

21. The coin processing device of claim 18, wherein each track comprises a stationary first member having a trapezoidal cross-sectional profile and each individually moveable platform comprises a substantially mating profile.

22. The coin processing device of claim 18, wherein, in said second inoperable position, said individually moveable platform is substantially cantilevered relative to said track.

* * * * *

UNITED STATES PATENT AND TRADEMARK OFFICE

CERTIFICATE OF CORRECTION

PATENT NO. : 8,393,455 B2
APPLICATION NO. : 10/797839
DATED : March 12, 2013
INVENTOR(S) : Blake et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2309 days.

Signed and Sealed this
Sixteenth Day of December, 2014

Michelle K. Lee

Michelle K. Lee
*Deputy Director of the United States Patent and Trademark Office*